US011145159B2

(12) United States Patent
Russ et al.

(10) Patent No.: US 11,145,159 B2
(45) Date of Patent: Oct. 12, 2021

(54) GAMING SYSTEM INCLUDING DISPLAY DEVICE THAT PRODUCES LOCALIZED IN-SCREEN SOUNDS

(71) Applicant: IGT, Las Vegas, NV (US)

(72) Inventors: Michael Russ, Graz (AT); David Froy, Jr., Lakeville-Westmorland (CA); Stefan Keilwert, St. Josef (AT)

(73) Assignee: IGT, Las Vegas, NV (US)

( * ) Notice: Subject to any disclaimer, the term of this patent is extended or adjusted under 35 U.S.C. 154(b) by 23 days.

(21) Appl. No.: 16/694,073

(22) Filed: Nov. 25, 2019

(65) Prior Publication Data

US 2021/0158650 A1 May 27, 2021

(51) Int. Cl.
*G07F 17/32* (2006.01)
*G07F 17/34* (2006.01)

(52) U.S. Cl.
CPC ..... *G07F 17/3213* (2013.01); *G07F 17/3211* (2013.01); *G07F 17/34* (2013.01); *G07F 17/3206* (2013.01)

(58) Field of Classification Search
None
See application file for complete search history.

(56) References Cited

U.S. PATENT DOCUMENTS

| | | | |
|---|---|---|---|
| 7,338,373 | B2 | 3/2008 | Kawamura |
| 8,357,042 | B2 | 1/2013 | Timperley |
| 8,622,830 | B2 | 1/2014 | Radek |
| 8,864,584 | B2 | 10/2014 | Radek et al. |
| 9,005,023 | B2 | 4/2015 | Bonney et al. |
| 9,965,917 | B2 | 5/2018 | Tsuchiya et al. |
| 10,163,295 | B2 | 12/2018 | Miura |
| 2008/0242411 | A1 | 10/2008 | Connelly |
| 2009/0247298 | A1 | 10/2009 | Tokuhara |
| 2017/0148250 | A1* | 5/2017 | Angermayer ..... G06T 19/20 |
| 2017/0294072 | A1* | 10/2017 | Achmuller ..... G07F 17/3206 |
| 2019/0266833 | A1 | 8/2019 | Lee et al. |

OTHER PUBLICATIONS

Kwan Ho Park, "Cinematic Sound OLED Technology", Jul. 25, 2019, OLED Space (Year: 2009).*
"LG's Crystal Sound OLEDs embed a sound system within the display panel", https://www.oled-info.com/lgs-crystal-sound-oleds-embed-sound-system-within-display-panel (3 pages), Jan. 5, 2017.

* cited by examiner

*Primary Examiner* — Damon J Pierce
(74) *Attorney, Agent, or Firm* — Neal, Gerber & Eisenberg LLP

(57) ABSTRACT

The present disclosure relates to electronic gaming systems, and more particularly electronic gaming machines having display devices that produce localized in-screen sounds.

9 Claims, 10 Drawing Sheets

GAMING SYSTEM INCLUDING DISPLAY DEVICE THAT PRODUCES LOCALIZED IN-SCREEN SOUNDS

BACKGROUND

The present disclosure relates to electronic gaming systems, and more particularly electronic gaming machines having display devices that produce localized in-screen sounds.

Various electronic gaming machines may be operable to enable play of wagering games. Various electronic gaming machines may include one or more primary wagering games. Various electronic gaming machines may also include one or more secondary games. Various electronic gaming machines may produce sounds from speakers in association with such games.

BRIEF SUMMARY

In various embodiments, the present disclosure provides an electronic gaming machine including a housing, a display device supported by the housing, a processor, and a memory device that stores a plurality of instructions. The plurality of instructions, when executed by the processor, cause the processor to cause the display device to display a play of a game, cause the display device to display an image including a 2D or 3D object, the 2D or 3D object having an object location with respect to a screen of the display device, and cause the display device to generate a sound associated with the 2D or 3D object, wherein the sound emanates from a sound location on the screen of the display device determined based on the object location.

In various embodiments, the present disclosure provides an electronic gaming machine including a housing, a display device supported by the housing, a player hand tracker supported by the housing, a processor, and a memory device that stores a plurality of instructions. The plurality of instructions, when executed by the processor, cause the processor to cause the display device to display a play of a game, cause the display device to display an image comprising an object, the object having an object location with respect to a screen of the display device, operate with the player hand tracker to capture player hand position information, compare the player hand position information to the object location, and cause the display device to generate a sound associated with the object based on the comparison, wherein the sound emanates from a sound location on the screen of the display device determined based on the object location.

In various embodiments, the present disclosure provides an electronic gaming machine including a housing, a display device supported by the housing, a processor, and a memory device that stores a plurality of instructions. The plurality of instructions, when executed by the processor, cause the processor to: cause the display device to display a play of a game, wherein the play of the game includes a plurality of symbols each having a symbol location relative to a screen of the display device; and cause the display device to generate a plurality of sounds corresponding to the plurality of symbols, wherein the plurality of sounds each emanate from a corresponding symbol location on the screen of the display device.

Additional features and advantages are described in, and will be apparent from, the following Detailed Description and the Figures.

DETAILED DESCRIPTION

Figure 1:
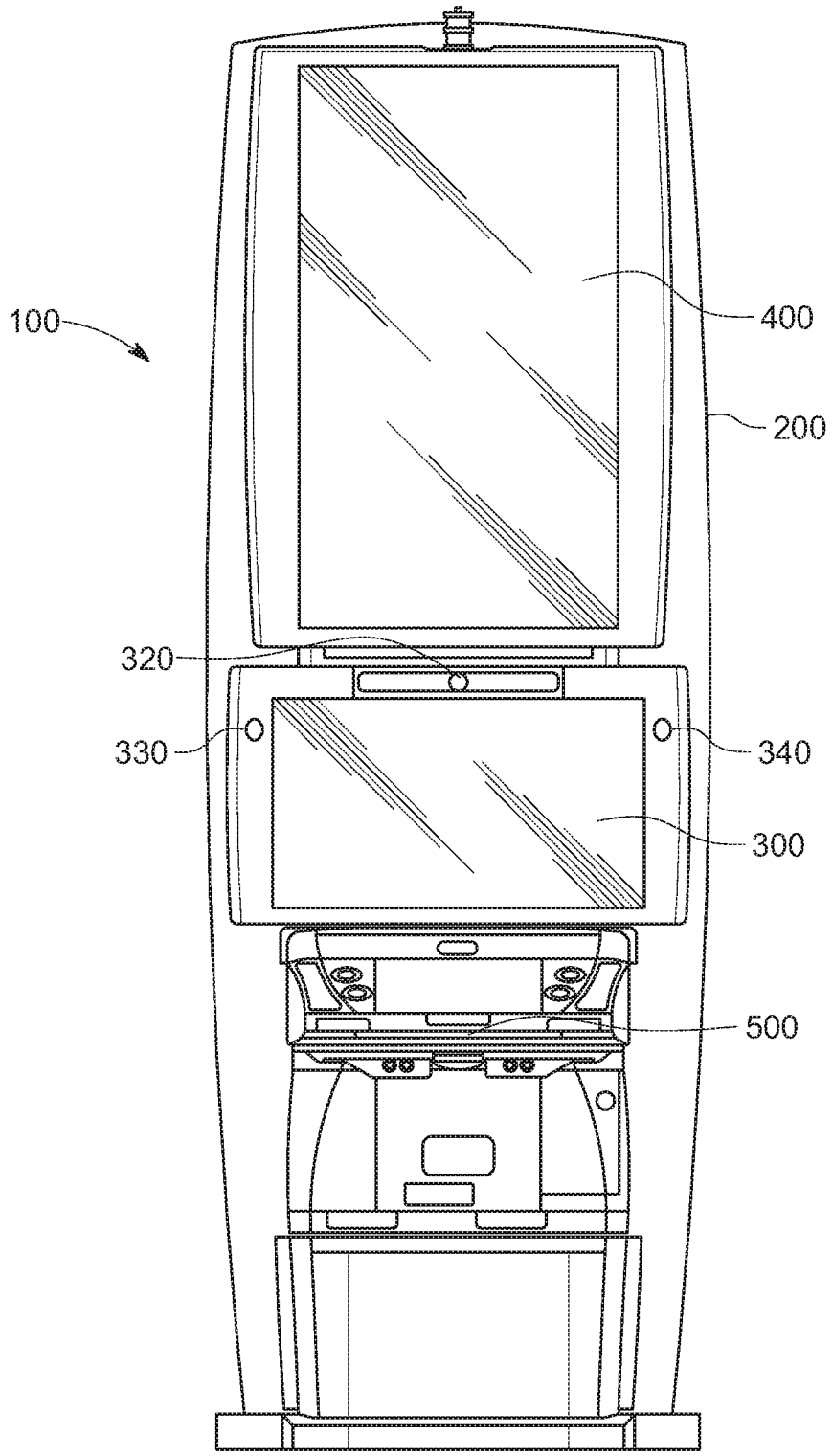
FIG. 1 is a front view of one example embodiment of an electronic gaming machine ("EGM") of the present disclosure.
Figure 2:
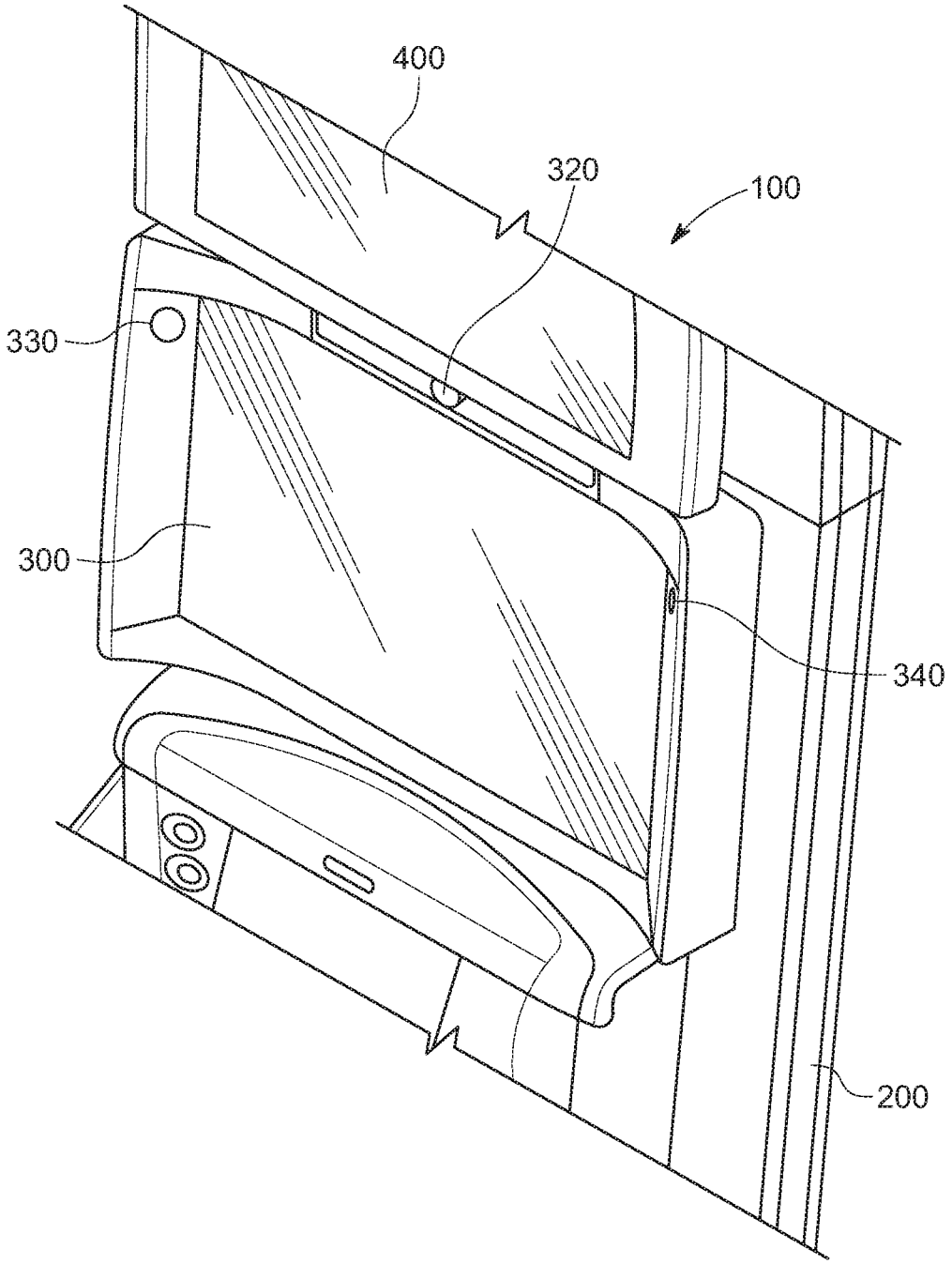
FIG. 2 is an enlarged fragmentary front perspective view of the central portion of the EGM of FIG. 1.
Figure 3:
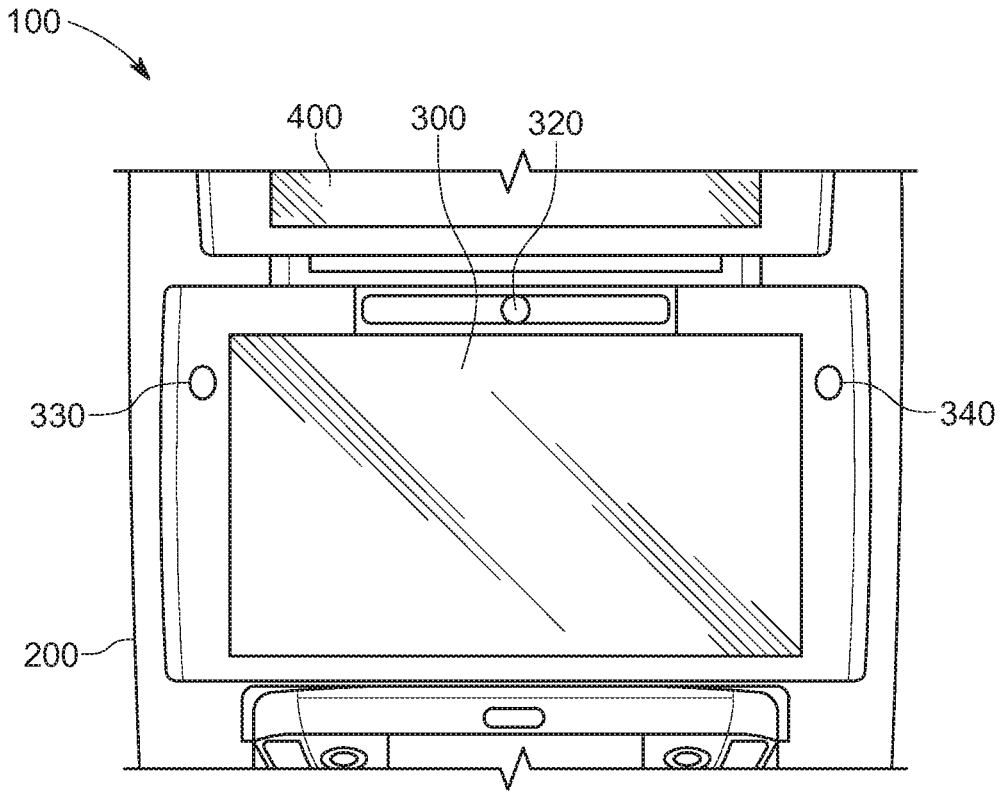
FIG. 3 is an enlarged fragmentary front view of the central portion of the EGM of FIG. 1.

The present disclosure provides relates to electronic gaming systems, and more particularly electronic gaming machines having display devices that produce localized in-screen sounds. For brevity and clarity, and unless specifically stated otherwise, the term "EGM" is used herein to refer to an electronic gaming machine (such as but not limited to a slot machine, a video poker machine, a video card machine, a video lottery terminal (VLT), a sports betting terminal, a video keno machine, or a video bingo machine).

For brevity, the term "3D image(s)" used herein includes any three dimensional image or three dimensional images or other content shown in 3D such as but not limited to moving or transforming 3D geometries, 3D videos, or movies, etc.

As used herein, the terms "3D environment" or "3D world" may be used interchangeably. A 3D environment includes one or more visual aspects (e.g., one or more 3D images) and one or more audio aspects (e.g., a 3D audio space). Physical objects in the 3D image are referred to herein as virtual objects. Objects in the 3D audio space are referred to herein as virtual audio objects. In various instances, a virtual audio object in the 3D audio space corresponds to a virtual object in the 3D image. For example, a virtual object may be a bell, while the corresponding virtual audio object may be an audio file that corresponds to the "ringing" sound a bell makes. In various embodiments, the 3D environment may be represented as two separate virtual spaces (e.g., the one or more visual aspects and the one or more audio aspects) that overlap. In various embodiments, the one or more visual aspects may use a first coordinate system and the one or more audio aspects may use a second coordinate system. In certain such embodiments, software such as a plurality of instructions stored on a memory device of the EGM when executed by the processor of the EGM compensates for the coordinate system(s). In certain embodiments, the first coordinate system and the second coordinate system may employ different scale factors, but generally overlap.

I. EGM—Display Device Configuration

Referring now to FIGS. 1 to 7, one example EGM of the present disclosure is generally illustrated and indicated by numeral 100. This example EGM 100 illustrated in FIGS. 1 to 3 generally includes a housing 200 (sometimes referred to herein as a "support structure" or a "cabinet") having a front side that supports a plurality output devices and a plurality of input devices of the EGM 100, among other components. In this example embodiment, the EGM 100 includes: (a) a first or intermediate display device 300 supported by the housing 200; (b) a head position tracker 320 supported by the housing 200; (c) a player hand tracker including cameras 330 and 340; and (d) a processor (not shown) and a memory device (not shown) that co-act or work together with the above-mentioned components to provide audio output in various circumstances described in further detail below.

In this example embodiment, the first or intermediate display device 300, the head position tracker 320, the player hand tracker, the processor, and the memory device are configured to produce and output sound beams by operating in real-time or substantially real-time basis to: (a) cause the first or intermediate display device 300 to display a play of a game; (b) cause the first or intermediate display device 300 to display a 3D image to a player, wherein the 3D image includes a virtual object associated with 3D coordinates; (c) operate with the head position tracker 320 to capture player head position information; (d) operate with the player hand tracker to capture player hand information; (e) cause the first or intermediate display device 300 to generate an audio stream based on the captured player head position information, the captured player hand information, and/or the 3D coordinates associated with the virtual object; and (f) cause the first or intermediate display device 300 to output the audio stream. It should be appreciated that the processor and the memory device may be configured to operate with one or more sound cards (not shown) to cause the production and output of sound beams by the first or intermediate display device 300. In certain embodiments, the processor and/or the memory device is integrated with the one or more sound cards. In certain embodiments, the one or more sound cards are integrated with the first or intermediate display device 300.

It should be appreciated that while the examples used in this disclosure mainly relate to 3D objects, the present disclosure is not limited to 3D objects and can apply to other objects such as 2D objects. For brevity, the term "2D image(s)" used herein includes any two dimensional image or two dimensional images or other content shown in 2D such as but not limited to moving or transforming 2D geometries, 2D videos, or movies, etc. It should be further appreciated that the 2D object(s) can be displayed by the display device at any suitable coordinates of the display device.

It should be appreciated that: (a) the first or intermediate display device 300; (b) the head position tracker 320; and (c) the player hand tracker, may each be individually configured or may alternatively be configured to operate with the processor and the memory device to provide each of their designated functions described herein. In other words: (a) the first or intermediate display device 300 may be individually configured to display images (e.g., 2D and/or 3D images) and produce audio streams, or may be configured to operate with the processor and the memory device to display images and produce audio streams; (b) the head position tracker 320 may be individually configured to track the movement of the eyes and/or head of the player or may be configured to operate with the processor and the memory device to track the movement of the eyes and/or head of the player; and (c) the player hand tracker may be individually configured to track the position and movement of a player's hand or may be configured to operate with the processor and the memory device to track the position and movement of the player's hand. Thus, for purposes of this disclosure and for brevity, each of these devices are sometimes discussed as performing such tasks individually or operating with the processor and the memory device to perform such tasks, and such descriptions are not intended to limit the present disclosure to either configuration.

In this illustrated example embodiment, the plurality of output devices includes: (a) the first or intermediate display device 300; (b) a second or upper display device 400 positioned above the first or intermediate display device 300; and (c) a third or lower display device 500 positioned below the first or intermediate display device 300. These output devices 300, 400, and 500 are configured to display the game(s), game outcome(s), award(s) (such as the primary and/or secondary game award(s) or other game outcome award(s)), and/or other functionality and information to the player.

In this illustrated example embodiment, one or more of the first display device 300, second display device 400, and third display device 500 may be configured to produce audio or sound waves. The display device can produce sound waves that emanate from the display device itself. The sound location at which the sound wave(s) is/are produced can be any suitable location on the screen of the display device. In some examples, the sound waved may be produced by vibrating the screen surface of the display device. Alternatively, the sound wave(s) may be produced by one or more components of the display device located behind the screen itself. The sound(s) may be produced such that it sounds or appears to a player as if the sound(s) is/are coming directly from the screen itself.

In this illustrated example embodiment, the plurality of player input devices enable the player to play one or more wager games provided by the EGM 100. Such player input devices can also include one or more input devices described below in the second (II) section of this detailed description. These player input devices are physically touchable or activatable by the player to enable the player to make inputs into the EGM 100. It should be appreciated that in certain embodiments, the player input devices are non-touch inputs, such as head trackers, eye gaze monitors, player hand trackers, etc.

These output and input devices are configured such that a player may operate the EGM 100 while standing or sitting, but preferably operates with the EGM 100 while the player is sitting in front of the EGM 100 such that the player's head is approximately at the same height as the first display device 300.

In this illustrated example embodiment, the first display device 300 of the EGM 100 is configured to display one or more 3D images to the player without requiring the player to wear 3D glasses. For example, the first display device 300 includes one or more auto-stereoscopic displays (not shown). In various embodiments, the first display device 300 including the auto-stereoscopic display (e.g., lenticular lens or lenses) is configured to display or project what appears to the player as one or more 3D virtual objects (shown in FIGS. 4, 5, and 6) that are projected towards the player or projected in a player interaction zone in front of the player. In certain embodiments, the first display device 300 including the auto-stereoscopic display is configured to display or project what appears to the player as one or more 3D virtual objects that appear to the player to be in front of or behind the front face or screen of the first display device 300.

In certain embodiments, the player interaction zone extends in front of the first display device 300 in somewhat of a cone shape. However, it should be appreciated that in other embodiments, the player interaction zone can be alternatively configured, such as to extend: (a) from a horizontal plane level with a top edge of the first display device 300 to a horizontal plane level with a bottom edge of the first display device 300; (b) from a vertical plane level with a right side edge of the first display device 300 to a vertical plane level with a left side edge of the first display device 300; and (c) from a vertical plane from a front face of the first display device 300 to a vertical plane approximately twelve inches from the front surface of the first display device 300. In other embodiments, the player interaction zone can be alternatively configured to extend: (a) from a horizontal plane level with the top edge of the first display device 300 to a horizontal plane level with the bottom edge of the first display device 300; (b) from a vertical plane level with the right side edge of the first display device 300 to a vertical plane level with the left side edge of the first display device 300; and (c) from a vertical plane from the front face of the first display device 300 to vertical plane approximately twelve inches from the front surface of the first display device 300. It should thus be appreciated that the size and shape of the player interaction zone may vary in accordance with the present disclosure.

It should also be appreciated that the size and shape of the player interaction zone may vary as the position of the player's eyes, hand(s), or head change in accordance with the present disclosure. In certain such embodiments, the far end of the cone of the player interaction zone is centered at the player's eyes or head, and when the player's eyes or head move, the player interaction zone changes. In other such embodiments, the far end of the cone of the player interaction zone is centered at the player's hand, and when the player's hand moves, the player interaction zone changes accordingly.

It should also be appreciated that other suitable 3D or virtual object displaying systems or devices can be employed in accordance with the present disclosure.

In this illustrated example embodiment, the head position tracker 320 of the EGM 100 is configured to track the movement of the eyes and/or the head of the player. The head position tracker 320 includes one or more eye tracking and/or head tracking cameras supported by the housing 200. In this illustrated example embodiment, the head position tracker 320 includes a camera that is positioned directly above the first display device 300.

Figure 4:
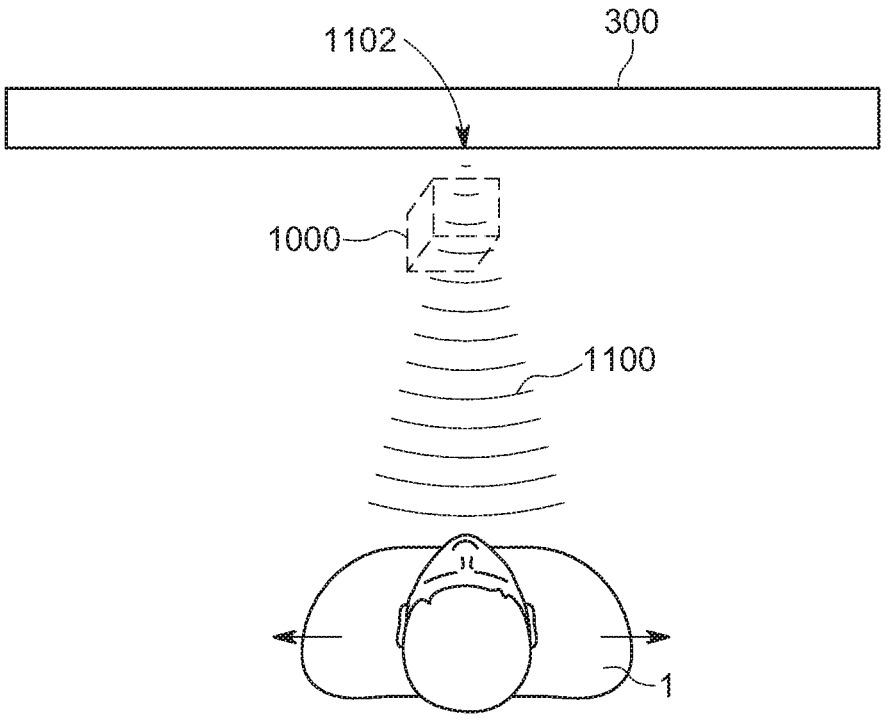
FIG. 4 is an enlarged diagrammatical top view of the central portion of the EGM of FIG. 1, depicting a 3D object and audio output from a display device of the EGM based on a first player position.
Figure 5:
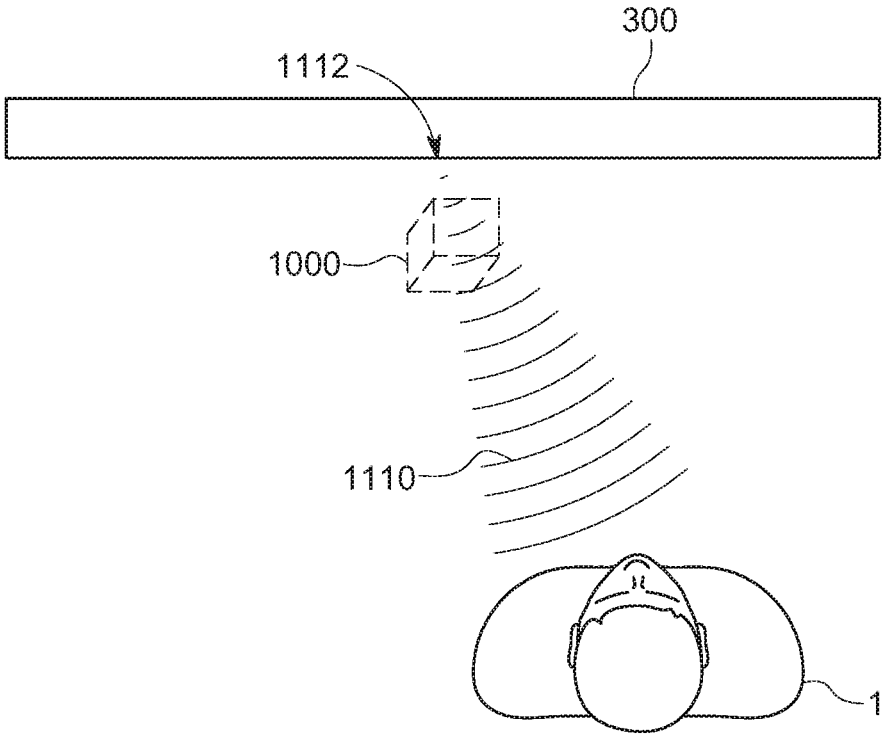
FIG. 5 is an enlarged diagrammatical top view of the central portion of the EGM of FIG. 1, depicting the 3D object and audio output from the display device of the EGM based on a second different player position.
Figure 6:
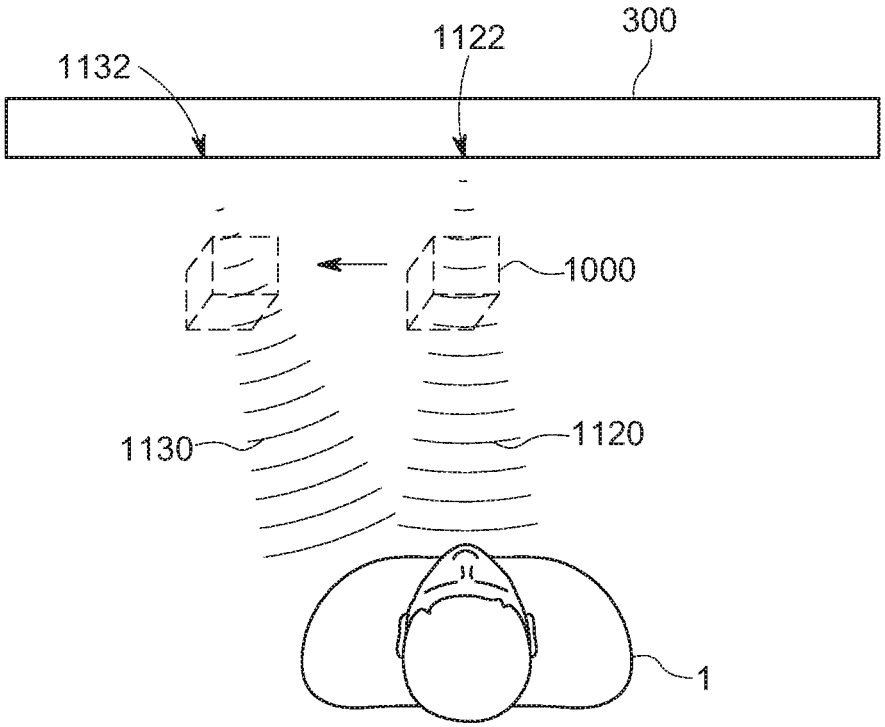
FIG. 6 is an enlarged diagrammatical top view of the central portion of the EGM of FIG. 1, depicting a 3D object and movement of a source of the audio output, based on a change in a position of the 3D object.

The head position tracker 320 is configured to track the position of the player's eyes and/or the player's head as the player moves in front of the first display device 300 and thus in front of the housing 200. More specifically, the head position tracker 320 is configured to track the position of the player's eyes and/or the player's head as the player moves in, for example, an eye/head tracking zone in front of the EGM 100 (as illustrated in FIGS. 4, 5, and 6). Other embodiments of the present disclosure include two or more eye tracking and/or head tracking cameras employed to work together to track the positions of the player's eyes and/or the player's head as the player moves in front of the first display device 300 and the housing 200. In various embodiments where two or more eye tracking and/or head tracking cameras are employed, such multiple cameras are spaced apart, such as spaced apart six inches.

In this illustrated example embodiment, the processor, the memory device, the head position tracker 320, the player hand tracker, and the first display device 300 of the EGM 100 align the coordinate system of the virtual display area (or world) with the real world by using player head position information and/or player hand position information (e.g., XYZ or 3D coordinates) obtained from the head position tracker 320 and/or player hand tracker. For the purpose of displaying virtual objects, when the player moves their head around, the first display device 300 may cause the virtual object(s) to appear to the player to stay in place where it is. Therefore, in this illustrated example embodiment, the EGM 100 uses the head position to fix the object(s) in space. The actual 2D stereo projection by the first display device 300 changes according to the head position, but to the player, the virtual object(s) appears or seems to stay where it is in the 3D image of the 3D environment. This is generally illustrated in FIGS. 4 and 5.

The EGM 100 uses the coordinate system to determine in real-time, or substantially real-time, the position (e.g., XYZ coordinates) of the player's head relative to the front side of the housing 200 (sometimes referred to herein as "player head position" information). As described below, the EGM 100 uses the determined position of the player's head (e.g., the player head position information) to determine and specifically to generate the visual and audio outputs related to the 3D object.

The first display device 300, the head position tracker 320, the one or more processor(s), and the one or more memory device(s) co-act or operate to track the player's eyes and/or head movements in an eye/head tracking zone in relation to the first display device 300 and the player interaction zone and to adjust the display or projection of each of the virtual object(s) in the player interaction zone based on the player eye and/or the player head movements. In various embodiments, the first display device 300 adjusts the image(s) to be seen by the player's left and right eyes based on the determined position(s) and movement(s) of the player's eyes and/or player's head.

The auto-stereoscopic display facilitates the perception of two different images for the left and right eye of the player. In other words, the auto-stereoscopic display causes certain pixels of the screen to be visible only (or primarily only) to the player's right eye and certain other pixels of the screen to be visible only (or primarily only) to the left eye of the player. When the player's head position is changed (i.e., the player's viewing angle is changed), the first display device 300 also changes the pixel positions for the left eye and the right eye of the player. The head position or changes thereto determined by the head position tracker 320 are used by the EGM 100 to choose or select the correct pixels for the left eye and the right eye of the player.

Examples of the head position tracker 320, including an eye tracker or head tracker, are described in U.S. patent application Ser. No. 15/707,639, entitled "Electronic Gaming Machine and Method Providing Enhanced Physical Player Interaction," filed on Sep. 18, 2017.

It should also be appreciated that other suitable eye tracking or head tracking systems or devices can be employed in accordance with the present disclosure.

In this illustrated example embodiment, the EGM 100 includes a player hand tracker that is configured to track or determine the position(s), orientation(s), and/or gesture(s) of at least one of the player's hands in front of the first display device 300. In some examples, there may be hand tracking zones which may be located to the left of the first display device 300, in front of the first display device 300 (i.e. a center zone), and/or to the right of the first display device, or a combination of all three. In this illustrated example embodiment, the player hand tracker includes a plurality of cameras 330 and 340 supported by the housing 200 and positioned adjacent to the first display device 300. In this illustrated embodiment, a first camera 330 is positioned directly to the right of the first display device 300 (looking forward) and a second camera 340 positioned directly to the left of the first display device 300 (looking forward). In this illustrated embodiment, the first camera 330 is positioned adjacent to an upper right hand corner of the first display device 300 and the second camera 340 is positioned adjacent to an upper left hand corner of the first display device 300.

It should be appreciated that in an alternative embodiment, the plurality of cameras can be positioned adjacent to a lower right hand corner of the first display device 300 and positioned adjacent to a lower left hand corner of the first display device 300. Furthermore, it should be appreciated that in an alternative embodiment, the plurality of cameras can be positioned such that their respective fields of view include the first display device 300 and/or an area directly in front of the first display device 300, such that a player's hand position with respect to the first display device can be determined. It should be appreciated that in other alternative embodiments, the plurality of cameras can be otherwise alternatively positioned in accordance with the present disclosure. It should also be appreciated that in other alternative embodiments, the EGM can include only one such camera or more than two such cameras in accordance with the present disclosure. In certain embodiments, the player hand tracker is configured to locate part of the player's hand, such as one or more fingers. In certain embodiments, the player hand position locator is configured to simultaneously locate both of the player's hands or locate multiple parts of the player's hands, such as two or more fingers.

In certain embodiments, the cameras 330 and 340 include time of flight depth camera sensors positioned at the two opposite sides of the first display device 300 and focused inwardly somewhat towards each other. This configuration enables the cameras 330 and 340 to track objects, such as one or more of the player's hands in the relatively large player hand tracking zones (i.e., the left, center or right zones). These right and left player hand tracking zones overlap the player interaction zone. In certain embodiments, the time of flight depth camera sensors make the EGM less prone to occlusions. In certain embodiments, the time of flight depth cameras also deliver point clouds that can be quickly analyzed and used by the processor(s) to make the necessary determinations. It should be appreciated that other suitable depth sensors (other than time of flight sensors) may be employed in accordance with the present disclosure.

It should be appreciated that the cameras 330 and 340 may be a camera device and/or a non-camera device, including video sensors, image sensors, time-of-flight depth sensors, audio (or acoustic) sensors, capacitive sensors, ultrasound sensors, magnetic field sensors, radar sensors, and/or laser sensors to track the movement of the eyes and/or the head of the player, as well as the hand and/or fingers of the player.

In certain embodiments, the EGM 100 uses the image data provided by the cameras 330 and 340 to determine the position(s) of the player's hand(s) in the right, center, and left player hand tracking zones and, thus, also in the player interaction zone. In certain embodiments, the EGM 100 creates the object depth images using point clouds provided by time of flight depth cameras and merges these point clouds to create one optimized point cloud that represents the object(s), such as the player's hand(s) in the right and/or left player hand tracking zones, and thus any portions thereof also in the player interaction zone and relative to the first display device 300. This provides a high degree of accuracy and a relatively large coverage area and player interaction zone (relative to a one camera system). In these embodiments, the EGM 100 determines in real time or substantially real time the position(s) (e.g., XYZ coordinates) of the object(s) such as the player's hand(s) in the player interaction zone, and uses the determined position(s) to carry out various actions described herein. In certain embodiments, the EGM 100 uses the determined position(s) for providing audio output by the first display device 300 synced with 3D gestures to the player in real-time or substantially real-time.

Using these two cameras 330 and 340 and keeping the camera resolution relatively low: (a) facilitates an increased size of the player interaction zone; and (b) reduces the need for high data rates and significant processing time or delays for image analysis that may slow down the EGM 100 and prevent real time or substantially real time 3D audio feedback synced with 3D gestures. Using these two cameras 330 and 340 also better facilitates the tracking of multiple player hands.

In certain embodiments, the EGM uses the image data provided by the cameras 330 and 340 to determine the closest depth of the end of the player's hand(s) such as the end of one of the player's fingers that is in the player interaction zone closest to the first display device 300. In other words, in these alternative embodiments, the EGM determines the nearest point (e.g., an XYZ coordinate relative to the first display device 300) of the object such as the player's hand to the first display device 300, and then uses that point as the reference for providing audio synced with the 3D gestures for the player in real-time or substantially real-time.

In certain embodiments, the EGM uses the image data provided by the cameras 330 and 340 to determine movements or gestures by the player's hand(s). In these embodiments, the EGM uses the determined gestures to provide the player audio synced with the 3D gestures in real time or substantially real time.

In certain embodiments, the EGM includes one or more camera sync cables (not shown) that sync the multiple cameras 330 and 340 to enhance the accuracy of the determination of the position(s) of player's hand(s) in the right, center, and left player hand tracking zones and in the player interaction zone. It should be appreciated that the image data from the multiple cameras can be synced in other suitable manners in accordance with the present disclosure.

Examples of player hand position locators are described in the U.S. patent application Ser. No. 15/707,639, entitled "Electronic Gaming Machine and Method Providing Enhanced Physical Player Interaction," filed on Sep. 18, 2017.

It should also be appreciated that other suitable player hand position locating systems or devices can be employed in accordance with the present disclosure.

For example, in various embodiments, the player hand position locator actually estimates the hand pose. The pose of the hand is not the position of the hand, but is instead the location and orientation of certain or every bone of the hand. In certain embodiments, the hand pose is determined by determining or specifying the 3D coordinates of a plurality of or every joint of the skeleton hand.

Referring now to FIGS. 4, 5, 6, 7, 8, 9A, 9B, and 9C, various examples of how the EGM can function to provide audio output by the first display device 300 are provided. It should be appreciated that the present disclosure is not limited to these examples, and that the EGM of the present disclosure can provide various types of audio.

FIGS. 4 and 5 illustrate one example operation of an EGM 100 of one embodiment of the present disclosure. FIG. 4 shows a virtual object 1000, and the first display device 300 outputting an audio signal 1100 based on first player head position information such that it appears to the player like the audio signal 1100 is produced by or coming from the virtual object 1000 itself. FIG. 5 shows the virtual object 1000 in the same relative position based on the movement of the player head, determined based on the player head position information. The first display device 300 in FIG. 5 outputs the audio signal 1110 from a second location on the first display device 300, such that it appears to the player 1 like the audio signal 1110 continues to come from the virtual object 1000, even though the player's head has moved.

For example, based on the first player head position information, the EGM 100 generates a virtual object, such as virtual object 1000. The EGM 100 then determines a location on the first display device 300 from which an audio signal should emanate, such that it appears to the player 1 like the audio signal is produced by or coming from the virtual object 1000. This location may be, for example, a location on a screen of the display device 300 directly in line with the virtual object and the player's head (e.g., a display vector). This location is shown as location 1102 in FIG. 4. The first display device 300 then outputs the audio from position 1102 on the display device 300.

When the player's head moves, this movement is captured by the EGM 100. The EGM 100 then determines a second location 1112 on the first display device 300 from which sound should be produced, such that it appears to the player 1 like the audio signal is continuing to be produced by or come from the virtual object 1000. The first display device 300 then outputs the sound from the second location 1112.

In certain embodiments, the EGM 100 adjusts the intensity (e.g., volume) of the audio signal based on the player head position information. For example, referring to FIGS. 4 and 5, the EGM 100 may increase the intensity level of the audio signal output by the first display device 300 in FIG. 5 because the position of the player head is farther away from the source of the sound (i.e., position 1112) as compared to the setup shown in FIG. 4. In other words, the volume may be increased or decreased depending on the distance from the location at which the audio signal is produced to the player's head. The distance between the player head and position 1102 (i.e., FIG. 4) is shorter than between the player head and position 1112 (i.e., FIG. 5), such that the volume may be increased in the scenario shown in FIG. 5 relative to the scenario shown in FIG. 4. By varying the intensity level in this manner, the player may experience a similar volume level produced by or coming "from" the virtual object 1000 regardless of the player's head position relative to the first display device 300.

FIG. 6 illustrates another example operation of EGM 100 of one embodiment of the present disclosure. FIG. 6 shows that virtual objects displayed by the EGM 100 may move (or change positions). In the illustrated example embodiment of FIG. 6, the virtual object 1000 (e.g., a virtual box) is initially positioned in a relatively center position of the first display device 300. The virtual object 1000 may then move to a relatively left-of-center position of the first display device 300 and/or to a relatively right-of-center position of the first display device 300. In the illustrated example embodiment, the EGM 100 updates the audio signal output position on the first display device 300 based on the movement of the virtual object. Similar to the scenarios disclosed with respect to FIGS. 4 and 5, the audio signal output position can change based on the position of the object 1000 such that it appears or seems to the player 1 as if the audio signal continues to be produced by or come "from" the object 1000. In particular, the first audio signal 1120 is produced by the display device 300 at a first position 1122. The second audio signal 1130 is produced by the display device 300 at a second position 1132. The positions 1122 and 1132 may be selected or determined based on the head position of the player 1, as well as the position of the object 1000, such that the three positions are aligned.

In certain embodiments, the EGM 100 may cause the display device 300 to display a play of a game. As a part of the game, or independent from the game, the display device may display an image comprising a 3D object. This is illustrated in FIGS. 4, 5, and 6. The 3D object has an object location in 3D space with respect to a screen of the display device 300. The EGM 100 may then cause the display device 300 to generate a sound associated with the 3D object, wherein the sound emanates from a sound location on the screen of the display device 300 determined based on the object location of the 3D object. It should be appreciated that in other various embodiments, the object is not a 3D object, but is an 2D object displayed by the display device in the relevant position(s) and the sound(s) emanate(s) from those relative positions.

As indicated above, the EGM 100 includes a head position tracker 320 supported by the housing 200. The head position tracker 320 may include a camera or other sensor. The head position tracker 320 captures player head position information. The player head position information is used to determine a head position of the player 1 with respect to the display device 300. The sound location is then determined in part based on the head position of the player 1. For example, the sound location, object location, and head position may be aligned with each other along a first axis. The object location and head location may be first determined, and based on these two locations, the sound location may be determined such that it is directly in line with the head position and object position along the first axis.

As illustrated in FIGS. 4 and 5, the EGM 100 can detect movement of the head position of the player 1, via the head position tracker 320. The EGM 100, and specifically the display device 300, can then move the sound location on the screen of the display device 300 from position 1102 to position 1112, responsive to this detected head position movement. The movement of the sound location can be determined such that the new sound location 1112, object location, and player head position remain aligned. The alignment may be along a second axis, which can be different than the first axis.

As illustrated in FIG. 6, the EGM 100 can move the object location of 3D object 1000 with respect to the display device 300 and head position of the player 1. In response, the EGM 100 can move the sound location on the screen of the display device 300 from position 1122 to position 1132, such that the new sound location 1132 remains aligned with the new object location and the player head position. The new sound location 1132, new object location, and player head position remain aligned along a third axis that is different from the first axis.

In certain embodiments the EGM 100 can cause the display device 100 to modify a volume of the sound output by the display device 300 based on the sound location. For example, in combination with the determined player head position, a distance between the player head position and the sound location can be determined. When (a) the object location changes, (b) the sound location changes, (c) the head position changes, or (d) a combination of any of (a), (b), and (c), a new distance between the head position of the player and the sound location on the screen of the display device can be determined. The volume or intensity of the output sound can be changed depending on the difference in the distances. This enables the EGM 100 to output a louder sound when the distance is larger, such that to the player it appears or sounds like the output sound remains the same volume.

In certain embodiments, the EGM 100 includes multiple display devices, such as display devices 300, 400, and 500 shown in FIG. 1. The concepts disclosed herein has been described largely with respect to the display device 300. However, it should be appreciated that various other display devices and sound output devices can be used in addition to or instead of display device 300. For example, an EGM can include a base screen (such as display device 500), a top screen (such as display device 400), a "topper," a button panel, signage, backlit glasses, and/or cabinet surfaces. Each of these may be configured to emit sound.

In certain embodiments, a given game may include the use of two or more screens (e.g., both display device 300 and display device 400). The gameplay mechanics may include prompting the player to look from one screen to the next, such as from the main display device 300 to the top display device 400. The top display device 400 can emit a sound to the player that causes the player to look up, toward the source of the sound. Ordinarily the game may include displaying arrows or instructions to "look up" toward the top display device. However, by causing the top display device 400 to produce its own sound, the player may automatically look up without the need for a visual prompt.

In certain embodiments, the player may interact with the 3D object 1000. In these cases, the display device 300 (and/or other display device in use) can produce a sound from a sound location that appears to the user as if the 3D object itself is producing the sound.

Figure 7:
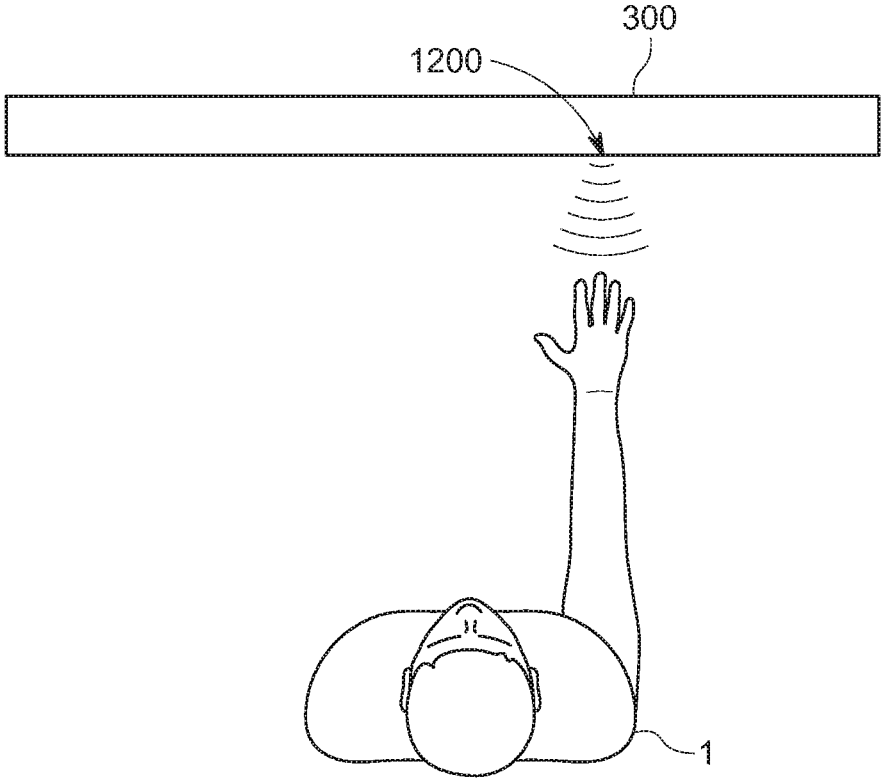
FIG. 7 is an enlarged diagrammatical top view of the central portion of the EGM of FIG. 1, depicting a user's hand near a display device of the EGM.

FIG. 7 illustrates another example operation of EGM 100 of one embodiment of the present disclosure. FIG. 7 shows that a player's hand position can be determined, and a sound can be output by the display device 300 based on the player hand position. In particular, the player hand position can be determined by the player hand tracker, including cameras 330 and 340, discussed in detail above. The player hand tracker can capture player hand position information. This player hand position information can be compared to an object location (either a 3D object such as object 1000, or a 2D object displayed on the screen of the display device 300). Then, based on this comparison, the display device 300 generates a sound associated with the object, wherein the sound emanates from a sound location (e.g., sound location 1200) on the screen of the display device 300 determined based on the object location.

In certain embodiments, the player hand tracker is included in the display device 300 itself. For example, the display device 300 can include a touch screen element, such as a capacitive, resistive, surface acoustic wave, optical, electromagnetic guidance, or other type of touch screen mechanism. The touch screen element can detect contact with the display device 300, as well as proximity of a player's hand to the display device 300. This enables the EGM to gather player hand position information, to detect the 3D position of the player's hand relative to the screen of the display device 300.

In certain embodiments, the EGM 100 can detect a point of contact between the player hand and the screen of the display device 300. The display device 300 can then generate one or more sounds that emanate(s) from the location of that point of contact. Similarly, the EGM 100 can detect the proximity between a player hand and the screen of the display device 300. The player hand tracker can detect that there is less than a threshold distance between the player hand and the screen of the display device 300. The display device 300 can then generate one or more sounds that emanate(s) from the display device 300 at a location on the display device 300 that is closest to the player hand position.

In certain embodiments, the display device 300 provides both touch functionality as well as audio output functionality at the same time. This is true particularly where the play hand tracker includes a touch screen element that is part of the display device 300.

In certain embodiments, the display device 300 (or another component of the EGM) can provide haptic feedback to a player. When the player contacts the screen of the display device 300, the display device 300 can provide standing sound waves (e.g., vibrating) that can be felt by the player. Furthermore, the player hand tracker can detect the proximity of the player's hand, and the display device 300 can responsively produce a sound before the player's hand makes contact with the display device 300. Additionally, the player hand tracker can include gesture detection in certain embodiments. In certain embodiments, the display device 300 can produce various sounds based on the detected gesture.

In certain embodiments, contact by a player with a displayed object (i.e., a 2D or 3D object), can trigger various outputs depending on the type of object, type of contact, and more. For example, touching an object (or button) can trigger a sound to be emitted by the display device 300 such that it appears to the player as if the sound is emanating from the object (or button) itself. Contact by the player via a single finger can cause a first sound to be produced. Alternatively, in certain embodiments, contact by the player via two or more fingers can result in a second sound, a different volume, or some other change to occur. Furthermore, in certain embodiments, the display device can detect the level of pressure applied by the contact of the player, and the sound type, volume, tone, or other characteristic of the output sound can be altered based on the detected level of pressure.

In certain embodiments, the display device 300 can produce a "touch recognized" sound from the spot at which contact is made (or the closes proximity between the player and the display device 300). Further, in certain embodiments the display device can be configured to replay a symbol animation and output a corresponding sound when the player touches a symbol displayed on the display device 300.

In certain embodiments, the display device 300 can vary a volume of various produced sounds depending on the player's current finger position in real time. For example, in a pick-a-prize feature of a game, the display device 300 can indicate the win range based on the current position of the player's finger. As the player drags his or her finger over the screen of the display device 300, the sound produced and location of the sound can indicate the range of the prize value hidden on objects, enabling the player to find the highest value based upon the sound produced and the current finger location. In another example embodiment, the display device 300 may display an audio or volume slider. The player may adjust the slider, and the display device 300 can output a sound corresponding to the current volume directly from the displayed slider.

Figure 8:
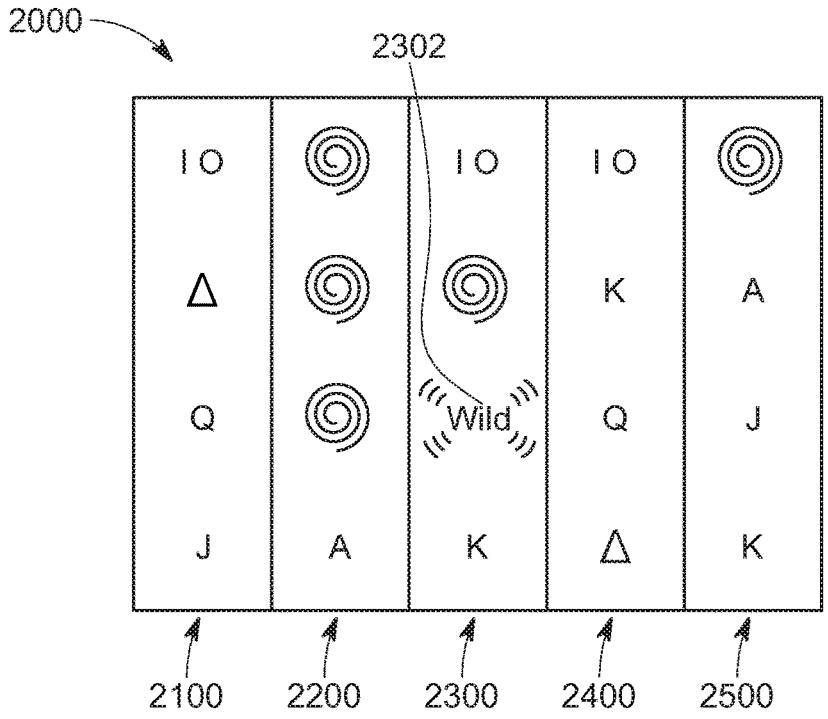
FIG. 8 is a front view of an example game displayed on a display device of the EGM of FIG. 1.

FIGS. 8, 9A, 9B, and 9C generally illustrate another example operation of EGM 100 of one embodiment of the present disclosure. FIG. 8 shows the first display device 300 including a plurality of displayed symbols. A sound corresponding to each symbol can be output by the first display device 300 from the location of the displayed symbol. In particular, FIG. 8 illustrates an example game 2000 displayed by the display device 300. The game 2000 includes a plurality of video reels 2100, 2200, and 2300, 2400, and 2500, each with a plurality of symbols. In the game illustrated by FIG. 8, the reels are all stopped, and the "wild" symbol 2302 is shown. Symbol 2302 includes a corresponding sound, which is output by the display device directly from the symbol location of the symbol 2302 on the screen.

In certain embodiments, the plurality of symbols displayed for a game include a plurality of symbols, which may or may not be different from each other. Each symbol has a corresponding sound, and each type of symbol can also have a corresponding sound. The sound corresponding to each symbol of the same type can be the same or can be different. For example, all "A" symbols can have a first corresponding sound, and all ("J") symbols can have a second corresponding sound that is different than the first sound. Further, each "A" symbol can have the same first corresponding sound, or may each have a different corresponding sound than the other "A" symbols. The sounds that correspond to a given symbol, symbol type, or group of symbols can be based on the symbol position, game state, and more.

In certain embodiments, the display device 300 can produce multiple sounds simultaneously, triggered by multiple game events and/or player touches. In some examples, each sound can be produced with an individual audio volume.

In certain embodiments, when the player selects a symbol, that may trigger a replay of the symbol animation (if applicable) along with the corresponding sound. Further, where the player selects an area of the screen, or contacts various sections of the display device 300, the display device 300 may produce a corresponding sound. This can include, for example, a coin counter, coins in a coin flight, objects in a pick-an-object feature, and more.

Figure 9A:
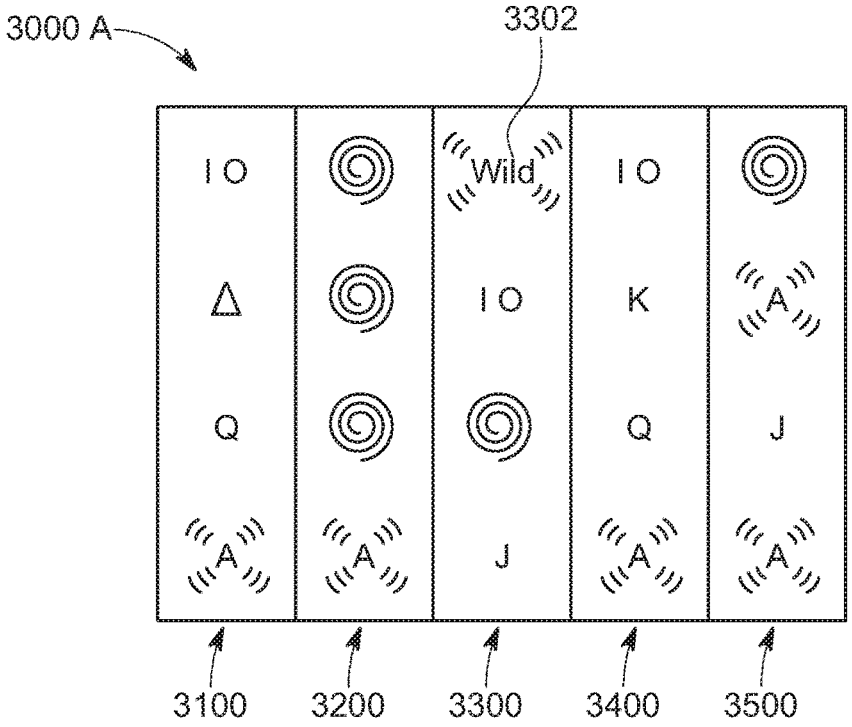
FIGS. 9A, 9B, and 9C are front views showing three respective game states of another example game displayed on the display device of the EGM of FIG. 1.
Figure 9B:
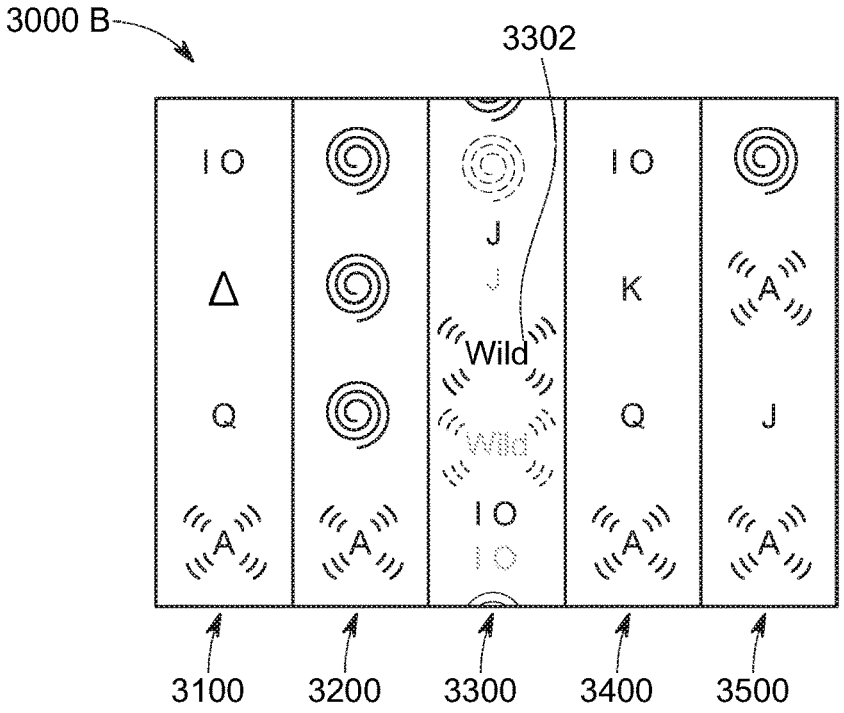
Figure 9C:
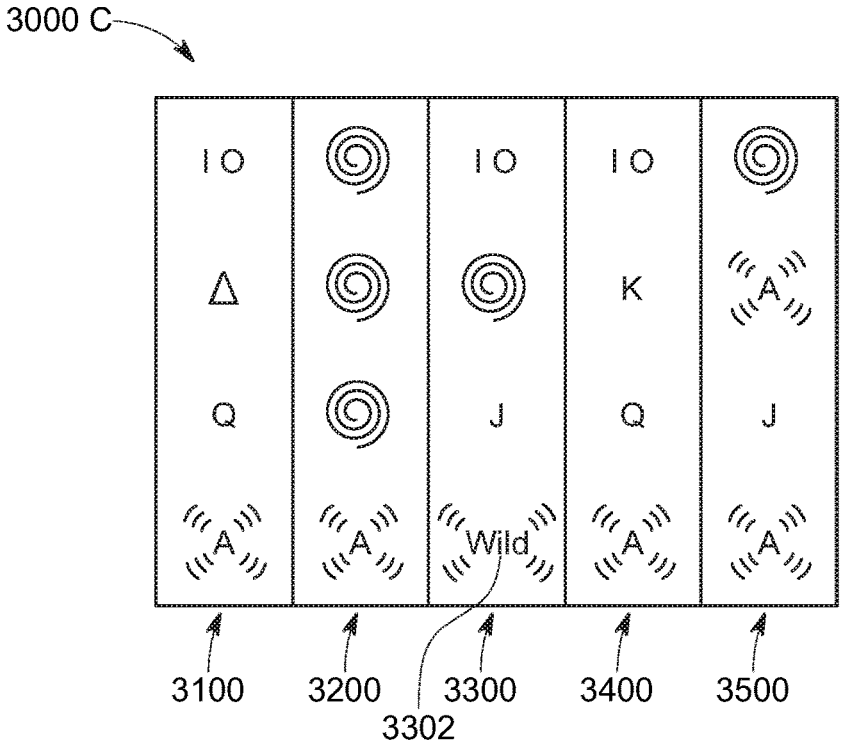

FIGS. 9A, 9B, and 9C illustrate a series of states 3000A, 3000B, and 3000C of a game, wherein a symbol in the middle reel travels from the top to the bottom. FIGS. 9A, 9B, and 9C show that as the position of the symbol changes, the location of the sound output on the first display device 300 also changes. FIG. 9A illustrates a state 3000A in which reels 3100, 3200, 3400, and 3500 are stopped, and reel 3300 is still spinning. The "A" symbol is shown on the video reels 3100, 3200, 3400, and 3500 aligned at the bottom of each reel. The "A" symbols on these reels have corresponding sounds, which are produced by the display device 300 at the symbol location of each "A" symbol. At state 3000A, the "A" symbols correspond to an anticipation state, in which the game is one symbol away from a winning line. The display device 300 produces an anticipation sound at the symbol location of each "A" symbol based on the game state. Additionally, the display device 300 produces a sound corresponding to the wild symbol 3302 in the third reel. The sound corresponding to the wild symbol 3302 can be based on the game state, wherein the sound depends on whether the wild symbol 3302, if stopped in the correct location, will result in a winning line. The sound corresponding to the wild symbol 3302 in this scenario can be the same or different than a sound associate with a non-anticipation game state (i.e., where the wild symbol stopping in a particular location will not result in a winning line).

FIG. 9B illustrates that video reels 3100, 3200, 3400, and 3500 are stopped, while video reel 3300 continues to spin. The wild symbol 3302 slides downward from the first location shown in FIG. 9A to the second location shown in FIG. 9B. In this embodiment, the display device 300 causes a sound corresponding to the wild symbol 3302 to be emanated from the display device along a path connecting the first location and the second location. The sound produced by the display device 300 follows the symbol 3302 as it moves. As the reel 3300 spins, the sound may reflect the movement of the symbol 3302, such as a "woosh" or other sound that reflects the symbol movement.

FIG. 9C illustrates that video reel 3300 has stopped, and symbol 3302 has landed on the bottom position. This has created a winning line across the bottom of reels 3100, 3200, 3300, 3400, and 3500. Each "A" symbol, and the wild symbol 3302 has a corresponding sound output from their respective symbol locations, indicating that there is a winning line.

In certain embodiments, the sound corresponding to a given symbol may change based on the current state of the game. For example, a symbol may have a standard sound, as well as an anticipation sound that is used when a winning line is possible, as well as a winning line sound when a winning line has occurred. It should be appreciated that these are only examples, and that various other game states and corresponding sounds can be used.

In a particular example, a first game state may include a plurality of spinning video reels. In this first game state, each symbol may have a corresponding first sound. A second game state can include one or more of the reels stopped and displaying a plurality of symbols. If the combination of symbols displayed on the stopped reels can result in a winning line, one or more of the symbols may have a corresponding second sound or anticipation sound. The second or anticipation sound can be different than the first sound. In a third game state, all of the reels are stopped, and a winning line is displayed. The symbols that make up the winning line can have a third sound that is either the same as or different than the first sound and the second sound.

In certain embodiments in which the game includes a plurality of spinning video reels, each reel portion of the display device can emit a sound individually. For instance, a reel start sound, a reel spin sound, and a reel stop sound. When a winning line is anticipated, a tension sound can be emitted from one or more reels (or symbols thereon). In some examples, binding features that are maintained across different or successive game states can continuously emit corresponding sounds as long as the binding feature is active or visible.

In certain embodiments, one or more symbols or objects in a given game move from a first screen to a second screen of the EGM. In this case, a sound corresponding to the symbol or object can also move from the first screen to the second screen.

In certain embodiments, in addition to the display device(s) producing sound, one or more other audio sources may be used. The EGM may include additional speakers or sound producing devices, which can be used in combination with the display device(s) to output sound that appears to come from or be produced by objects. These additional sound producing devices (e.g., speakers) can have individually adjustable volume control, which may be controlled via a slider displayed on the display device.

In certain embodiments, the frequency range of the display device sound output may be limited. Additional speakers can be used to support or supplement the usable frequency range of the display device. For example, a sound associated with a given object can be output by both the display device and a supplemental subwoofer. The output direction associated with the lower frequency output of the subwoofer is less noticeable to a player. Thus, it may not matter as much (or be noticeable to a player) whether the low frequency part of the sound is produced at the object location on the display device itself, or by some other part of the EGM.

It should be appreciated that various embodiments of the gaming system of the present disclosure do not necessarily require a position tracker (such as a head, eye, ear, or hand position tracker, and that the in-screen sound can be emitted without tracking and without being based on the player's position (or even entirely independent from a player's presence).

It should be appreciated from the above that various embodiments of the present disclosure improve gaming technology by providing EGMs that produce sounds in different manners for different physical interactions with players.

It should also be appreciated from the above that various embodiments of the present disclosure improve gaming technology by providing EGMs that provide a sound source that physically originates the a same or overlapping position as an object displayed by a display device and thus provides a physical overlap of the sound and the object It should also be appreciated from the above that various embodiments of the present disclosure improve gaming technology by providing EGMs that provide sounds from differently localized display positions.

It should also be appreciated from the above that various embodiments of the present disclosure improve gaming technology by providing EGMs that provide sounds from differently localized moving positions and/or from multiple different localized positions.

It should also be appreciated from the above that various embodiments of the present disclosure improve gaming technology by providing EGMs that provide an enhanced player-perceived 3D-like sound experience.

II. EGM—General Components and Operation

The EGM of the present disclosure can be controlled locally by one or more processors, and/or remotely or partially remotely by one or more remote processors, central servers, central controllers, or remote host. In various embodiments, the EGM of the present disclosure can be part of a gaming system (which is also part of the present disclosure) that includes one or more EGMs in combination with one or more remote processors, central servers, central controllers, or remote hosts. In such embodiments, the EGM is configured to communicate with the remote processors, central servers, central controllers, or remote hosts through a data network or remote communication link. In certain such embodiments, the EGM is configured to communicate with one or more other EGMs through the same data network or remote communication link or through a different data network or remote communication link.

In certain embodiments in which the gaming system includes an EGM in combination with a remote processor, central server, central controller, or remote host, the remote processor, central server, central controller, or remote host is any suitable computing device that includes at least one processor and at least one memory device or data storage device. As further described herein, the EGM includes at least one EGM processor configured to transmit and receive data or signals representing events, messages, commands, or any other suitable information between the EGM and the remote processor, central server, central controller, or remote host. The at least one processor of that EGM is configured to execute the events, messages, or commands represented by such data or signals in conjunction with the operation of the EGM. Moreover, the at least one processor of the remote processor, central server, central controller, or remote host is configured to transmit and receive data or signals representing events, messages, commands, or any other suitable information between the remote processor, central server, central controller, or remote host and the EGM. One, more than one, or each of the functions of the at least one processor of the EGM may be performed by the remote processor, the central server, the central controller, or the remote host.

In certain such embodiments, computerized instructions for controlling any games (such as any primary or base games and/or any secondary or bonus games) displayed by the EGM are executed by the remote processor, central server, central controller, or remote host. In such "thin client" embodiments, the remote processor, central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the remote processor, central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a remote processor, central server, central controller, or remote host, computerized instructions for controlling any primary or base games displayed by the EGM are communicated from the remote processor, central server, central controller, or remote host to the EGM in a thick client configuration, and computerized instructions for controlling any secondary or bonus games or other functions displayed by the EGM are executed by the remote processor, central server, central controller, or remote host in a thin client configuration.

In certain embodiments in which the gaming system includes: (a) an EGM configured to communicate with a remote processor, central server, central controller, or remote host through a data network; and/or (b) a plurality of EGMs configured to communicate with one another through a data network, the data network is a local area network (LAN) in which the EGMs are located substantially proximate to one another and/or the remote processor, central server, central controller, or remote host. In one example, the EGMs and the remote processor, central server, central controller, or remote host are located in a gaming establishment or a portion of a gaming establishment.

In other embodiments in which the gaming system includes: (a) an EGM configured to communicate with a remote processor, central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the remote processor, central server, central controller, or remote host. For example, one or more of the EGMs are located: (a) in an area of a gaming establishment different from an area of the gaming establishment in which the remote processor, central server, central controller, or remote host is located; or (b) in a gaming establishment different from the gaming establishment in which the remote processor, central server, central controller, or remote host is located. In another example, the remote processor, central server, central controller, or remote host is not located within a gaming establishment in which the EGMs are located. In certain embodiments in which the data network is a WAN, the gaming system includes a remote processor, central server, central controller, or remote host and an EGM each located in a different gaming establishment in a same geographic area, such as a same city or a same state. Gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a remote processor, central server, central controller, or remote host through a data network; and/or (b) a plurality of EGMs configured to communicate with one another through a data network, the data network is an internet (such as the Internet) or an intranet. In certain such embodiments, an Internet browser of the EGM is usable to access an Internet game page from any location where an Internet connection is available. In one such embodiment, after the EGM accesses the Internet game page, the remote processor, central server, central controller, or remote host identifies a player prior to enabling that player to place any wagers on any plays of any wagering games. In one example, the remote processor, central server, central controller, or remote host identifies the player by requiring a player account of the player to be logged into via an input of a unique username and password combination assigned to the player. The remote processor, central server, central controller, or remote host may, however, identify the player in any other suitable manner, such as: by validating a player tracking identification number associated with the player; by reading a player tracking card or other smart card inserted into a card reader (as described below); by validating a unique player identification number associated with the player by the remote processor, central server, central controller, or remote host; or by identifying the EGM, such as by identifying the MAC address or the IP address of the Internet facilitator. In various embodiments, once the remote processor, central server, central controller, or remote host identifies the player, the remote processor, central server, central controller, or remote host enables placement of one or more wagers on one or more plays of one or more primary or base games and/or one or more secondary or bonus games, and displays those plays via the Internet browser of the EGM. Examples of implementations of Internet-based gaming are further described in U.S. Pat. No. 8,764,566, entitled "Internet Remote Game Server," and U.S. Pat. No. 8,147,334, entitled "Universal Game Server."

The remote processor, central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

Figure 10:
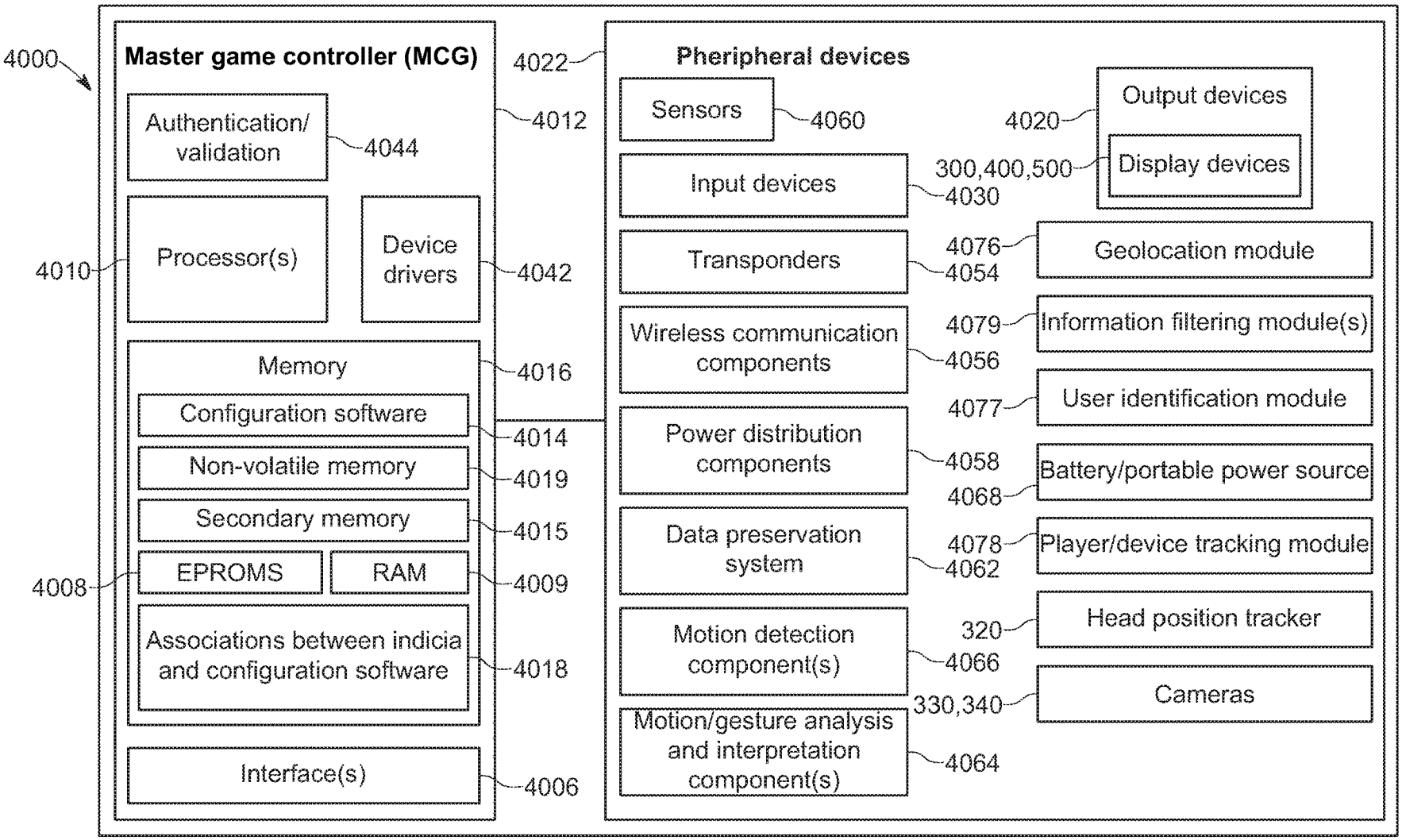
FIG. 10 is a schematic block diagram of one example embodiment of the electronic configuration of an example EGM of the present disclosure.

Referring now to FIG. 10, in various embodiments, the EGM 4000 includes a master gaming controller 4012 configured to communicate with and to operate with a plurality of peripheral devices 4022 (in addition to and including the above described devices 320, 330, 340). While the EGM 4000 includes components of the EGM 100 of FIGS. 1 to 3, it should be appreciated that the EGM 4000 may correspond any of the other EGMs disclosed herein.

The master gaming controller 4012 includes at least one processor 4010. The at least one processor 4010 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface 4006 of the master gaming controller 4012; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices 4022 (such as input/output devices); and/or (5) controlling the peripheral devices 4022. In certain embodiments, one or more components of the master gaming controller 4012 (such as the at least one processor 4010) reside within a housing of the EGM (described below), while in other embodiments at least one component of the master gaming controller 4012 resides outside of the housing of the EGM.

The master gaming controller 4012 also includes at least one memory device 4016, which includes: (1) volatile memory (e.g., RAM 4009, which can include non-volatile RAM, magnetic RAM, ferroelectric RAM, and any other suitable forms); (2) non-volatile memory 4019 (e.g., disk memory, FLASH memory, EPROMs, EEPROMs, memristor-based non-volatile solid-state memory, etc.); (3) unalterable memory (e.g., EPROMs 4008); (4) read-only memory; and/or (5) a secondary memory storage device 4015, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device 4016 resides within the housing of the EGM (described below), while in other embodiments at least one component of the at least one memory device 4016 resides outside of the housing of the EGM.

The at least one memory device 4016 is configured to store, for example: (1) configuration software 4014, such as all the parameters and settings for a game playable on the EGM; (2) associations 4018 between configuration indicia read from an EGM with one or more parameters and settings; (3) communication protocols configured to enable the at least one processor 4010 to communicate with the peripheral devices 4022; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols. In one implementation, the master gaming controller 4012 communicates with other devices using a serial communication protocol. A few non-limiting examples of serial communication protocols that other devices, such as peripherals (e.g., a bill validator or a ticket printer), may use to communicate with the master game controller 4012 include USB, RS-232, and Netplex (a proprietary protocol developed by IGT).

In certain embodiments, the at least one memory device 4016 is configured to store program code and instructions executable by the at least one processor of the EGM to control the EGM. The at least one memory device 4016 of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

The at least one memory device 4016 also stores a plurality of device drivers 4042. Examples of different types of device drivers include device drivers for EGM components and device drivers for the peripheral components 4022. Typically, the device drivers 4042 utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device 4016 can be upgraded as needed. For instance, when the at least one memory device 4016 is a hard drive, new games, new game options, new parameters, new settings for existing parameters, new settings for new parameters, new device drivers, and new communication protocols can be uploaded to the at least one memory device 4016 from the master game controller 4012 or from some other external device. As another example, when the at least one memory device 4016 includes a CD/DVD drive including a CD/DVD configured to store game options, parameters, and settings, the software stored in the at least one memory device 4016 can be upgraded by replacing a first CD/DVD with a second CD/DVD. In yet another example, when the at least one memory device 4016 uses flash memory 4019 or EPROM 4008 units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In certain embodiments, the at least one memory device 4016 also stores authentication and/or validation components 4044 configured to authenticate/validate specified EGM components and/or information, such as hardware components, software components, firmware components, peripheral device components, user input device components, information received from one or more user input devices, information stored in the at least one memory device 4016, etc. Examples of various authentication and/or validation components are described in U.S. Pat. No. 6,620,047, entitled "Electronic Gaming Apparatus Having Authentication Data Sets."

In certain embodiments, in addition to the input, output and other components described in the first section above, the peripheral devices 4022 include several device interfaces, such as: (1) at least one output device 4020 including at least one display device; (2) at least one input device 4030 (which may include contact 'and/or non-contact interfaces); (3) at least one transponder 4054; (4) at least one wireless communication component 4056; (5) at least one wired/wireless power distribution component 4058; (6) at least one sensor 4060; (7) at least one data preservation component 4062; (8) at least one motion/gesture analysis and interpretation component 4064; (9) at least one motion detection component 4066; (10) at least one portable power source 4068; (11) at least one geolocation module 4076; (12) at least one user identification module 4077; (13) at least one player/device tracking module 4078; and (14) at least one information filtering module 4079.

The at least one output device 4020 includes at least one display device configured to display any game(s) displayed by the EGM and any suitable information associated with such game(s). In certain embodiments, the display devices are connected to or mounted on a housing of the EGM (described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 100 illustrated in FIG. 1 includes a first display device 300, a player tracking display, a credit display, and a bet display.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device 4020 includes a payout device. In these embodiments, after the EGM receives an actuation of a cashout device (described below), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. The example EGM 100 and illustrated in FIG. 1 may include a ticket printer and dispenser. Examples of ticket-in ticket-out (TITO) technology are described in U.S. Pat. No. 5,429,361, entitled "Gaming Machine Information, Communication and Display System"; U.S. Pat. No. 5,470,079, entitled "Gaming Machine Accounting and Monitoring System"; U.S. Pat. No. 5,265,874, entitled "Cashless Gaming Apparatus and Method"; U.S. Pat. No. 6,729,957, entitled "Gaming Method and Host Computer with Ticket-In/Ticket-Out Capability"; U.S. Pat. No. 6,729,958, entitled "Gaming System with Ticket-In/Ticket-Out Capability"; U.S. Pat. No. 6,736,725, entitled "Gaming Method and Host Computer with Ticket-In/Ticket-Out Capability"; U.S. Pat. No. 7,275,991, entitled "Slot Machine with Ticket-In/Ticket-Out Capability"; and U.S. Pat. No. 6,048,269, entitled "Coinless Slot Machine System and Method."

In certain embodiments, rather than dispensing bills, coins, or a physical ticket having a monetary value to the player following receipt of an actuation of the cashout device, the payout device is configured to cause a payment to be provided to the player in the form of an electronic funds transfer, such as via a direct deposit into a bank account, a casino account, or a prepaid account of the player; via a transfer of funds onto an electronically recordable identification card or smart card of the player; or via sending a virtual ticket having a monetary value to an electronic device of the player. Examples of providing payment using virtual tickets are described in U.S. Pat. No. 8,613,659, entitled "Virtual Ticket-In and Ticket-Out on a Gaming Machine."

While any credit balances, any wagers, any values, and any awards are described herein as amounts of monetary credits or currency, one or more of such credit balances, such wagers, such values, and such awards may be for non-monetary credits, promotional credits, of player tracking points or credits.

In certain embodiments, the at least one output device 4020 includes one or more sound generating devices controlled by one or more sound cards. In one such embodiment, the sound generating device includes one or more speakers or other sound generating hardware and/or software configured to generate sounds, such as by playing music for any games or by playing music for other modes of the EGM, such as an attract mode. The example EGM 100 illustrated in FIG. 1 includes a plurality of speakers. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device 4030 may include any suitable device that enables an input signal to be produced and received by the at least one processor 4010 of the EGM.

In one embodiment, the at least one input device 4030 includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. The example EGM 100 illustrated in FIG. 1 may include a combined bill and ticket acceptor and a coin slot.

In one embodiment, the at least one input device 4030 includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. Examples of funding an EGM via communication between the EGM and a mobile device (such as a mobile phone) of a player are described in U.S. Patent Application Publication No. 2013/0344942, entitled "Avatar as Security Measure for Mobile Device Use with Electronic Gaming Machine." When the EGM is funded, the at least one processor determines the amount of funds entered and displays the corresponding amount on a credit display or any other suitable display as described below.

In certain embodiments, the at least one input device 4030 includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device 4030 includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. The example EGM 100 illustrated in FIG. 1 may include a game play activation device in the form of a game play initiation button. In other embodiments, the EGM begins game play automatically upon appropriate funding rather than upon utilization of the game play activation device.

In other embodiments, the at least one input device 4030 includes a cashout device. In various embodiments, the cashout device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cashout device from a player and the player has a positive (i.e., greater-than-zero) credit balance, the EGM initiates a payout associated with the player's credit balance. The example EGM 100 illustrated in FIG. 1 may include a cashout device in the form of a cashout button.

In various embodiments, the at least one input device includes a plurality of buttons that are programmable by the EGM operator to, when actuated, cause the EGM to perform particular functions. For instance, such buttons may be hard keys, programmable soft keys, or icons displayed on a display device of the EGM (described below) that are actuatable via a touch screen of the EGM (described below) or via use of a suitable input device of the EGM (such as a mouse or a joystick). The example EGM 100 illustrated in FIG. 1 may include a plurality of such buttons.

In certain embodiments, the at least one input device 4030 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device 4030 includes a card reader in communication with the at least one processor of the EGM. The example EGM 100 illustrated in FIG. 1 may include a card reader. The card reader is configured to read a player identification card inserted into the card reader.

The at least one wireless communication component 4056 includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 4056 transmits electrical, electromagnetic, or optical signals that carry digital data streams or analog signals representing various types of information.

The at least one wired/wireless power distribution component 4058 includes components or devices that are configured to provide power to other devices. For example, in one embodiment, the at least one power distribution component 4058 includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component 4058 is configured to distribute power to one or more internal components of the EGM, such as one or more rechargeable power sources (e.g., rechargeable batteries) located at the EGM.

In certain embodiments, in addition to the components described in the first section above, the at least one sensor 4060 includes at least one of: optical sensors, pressure sensors, RF sensors, infrared sensors, image sensors, thermal sensors, and biometric sensors. The at least one sensor 4060 may be used for a variety of functions, such as: detecting movements and/or gestures of various objects within a predetermined proximity to the EGM (in addition to the detections described above); detecting the presence and/or identity of various persons (e.g., players, casino employees, etc.), devices (e.g., user input devices), and/or systems within a predetermined proximity to the EGM.

The at least one data preservation component 4062 is configured to detect or sense one or more events and/or conditions that, for example, may result in damage to the EGM and/or that may result in loss of information associated with the EGM. Additionally, the data preservation system 4062 may be operable to initiate one or more appropriate action(s) in response to the detection of such events/conditions.

In addition to the player tracker described above, the EGM of the present disclosure can also include at least one motion/gesture analysis and interpretation component 4064 configured to analyze and/or interpret information relating to detected player movements and/or gestures to determine appropriate player input information relating to the detected player movements and/or gestures. For example, in one embodiment, the at least one motion/gesture analysis and interpretation component 4064 is configured to perform one or more of the following functions: analyze the detected gross motion or gestures of a player; interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one portable power source 4068 enables the EGM 4000 to operate in a mobile environment. For example, in one embodiment, the EGM 100 includes one or more rechargeable batteries.

The at least one geolocation module 4076 is configured to acquire geolocation information from one or more remote sources and use the acquired geolocation information to determine information relating to a relative and/or absolute position of the EGM. For example, in one implementation, the at least one geolocation module 4076 is configured to receive GPS signal information for use in determining the position or location of the EGM. In another implementation, the at least one geolocation module 4076 is configured to receive multiple wireless signals from multiple remote devices (e.g., EGMs, servers, wireless access points, etc.) and use the signal information to compute position/location information relating to the position or location of the EGM.

The at least one user identification module 4077 is configured to determine the identity of the current user or current owner of the EGM. For example, in one embodiment, the current user is required to perform a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module 4079 is configured to perform filtering (e.g., based on specified criteria) of selected information to be displayed at one or more displays of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. U.S. Pat. No. 7,290,072 describes a variety of EGMs including one or more communication ports that enable the EGMs to communicate and operate with one or more external peripherals.

In certain embodiments, the EGM is a device that has obtained approval from a regulatory gaming commission, and in other embodiments, the EGM is a device that has not obtained approval from a regulatory gaming commission.

The EGMs described above are merely examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

In various embodiments, an EGM may be implemented in one of a variety of different configurations. In various embodiments, the EGM may be implemented as one of: (a) a dedicated EGM in which computerized game programs executable by the EGM for controlling any primary or base games (sometimes referred to herein as "primary games") and/or any secondary or bonus games or other functions (sometimes referred to herein as "secondary games") displayed by the EGM are provided with the EGM prior to delivery to a gaming establishment or prior to being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a remote processor, central server, central controller, or remote host and a changeable EGM, the at least one memory device of the remote processor, central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the remote processor, central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the EGM randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the EGM generates the game outcome(s) and/or the award(s) to be provided based on the associated probabilities. In these embodiments, since the EGM generates game outcomes and/or awards randomly or based on one or more probability calculations, there is no certainty that the EGM will ever provide any specific game outcome and/or award.

In certain embodiments, the EGM maintains one or more predetermined pools or sets of predetermined game outcomes and/or awards. In certain such embodiments, upon generation or receipt of a game outcome and/or award request, the EGM independently selects one of the predetermined game outcomes and/or awards from the one or more pools or sets. The EGM flags or marks the selected game outcome and/or award as used. Once a game outcome or an award is flagged as used, it is prevented from further selection from its respective pool or set; that is, the EGM does not select that game outcome or award upon another game outcome and/or award request. The EGM provides the selected game outcome and/or award. Examples of this type of award evaluation are described in U.S. Pat. No. 7,470,183, entitled "Finite Pool Gaming Method and Apparatus"; U.S. Pat. No. 7,563,163, entitled "Gaming Device Including Outcome Pools for Providing Game Outcomes"; U.S. Pat. No. 7,833,092, entitled "Method and System for Compensating for Player Choice in a Game of Chance"; U.S. Pat. No. 8,070,579, entitled "Bingo System with Downloadable Common Patterns"; and U.S. Pat. No. 8,398,472, entitled "Central Determination Poker Game."

In certain embodiments, the EGM determines a predetermined game outcome and/or award based on the results of a bingo, keno, or lottery game. In certain such embodiments, the EGM utilizes one or more bingo, keno, or lottery games to determine the predetermined game outcome and/or award provided for a primary game and/or a secondary game. The EGM is provided or associated with a bingo card. Each bingo card consists of a matrix or array of elements, wherein each element is designated with separate indicia. After a bingo card is provided, the EGM randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. Examples of this type of award determination are described in U.S. Pat. No. 7,753,774, entitled "Using Multiple Bingo Cards to Represent Multiple Slot Paylines and Other Class III Game Options"; U.S. Pat. No. 7,731,581, entitled "Multi-Player Bingo Game with Multiple Alternative Outcome Displays"; U.S. Pat. No. 7,955,170, entitled "Providing Non-Bingo Outcomes for a Bingo Game"; U.S. Pat. No. 8,070,579, entitled "Bingo System with Downloadable Common Patterns"; and U.S. Pat. No. 8,500,538, entitled "Bingo Gaming System and Method for Providing Multiple Outcomes from Single Bingo Pattern."

In certain embodiments in which the EGM is configured to communicate with the remote processor, central server, central controller, or remote host for monitoring purposes only. In such embodiments, the EGM determines the game outcome(s) and/or award(s) to be provided in any of the manners described above, and the remote processor, central server, central controller, or remote host monitors the activities and events occurring on the EGM. In one such embodiment, the EGM includes a real-time or online accounting and gaming information system configured to communicate with the central server, central controller, or remote host. In this embodiment, the accounting and gaming information system includes: (a) a player database configured to store player profiles, (b) a player tracking module configured to track players (as described below), and (c) a credit system configured to provide automated transactions. Examples of such accounting systems are described in U.S. Pat. No. 6,913,534, entitled "Gaming Machine Having a Lottery Game and Capability for Integration with Gaming Device Accounting System and Player Tracking System," and U.S. Pat. No. 8,597,116, entitled "Virtual Player Tracking and Related Services."

As noted above, in various embodiments, the EGM includes one or more executable game programs executable by at least one processor of the EGM to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the EGM includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the EGM. In certain such embodiments, the EGM includes one or more paylines associated with the reels. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The EGM enables a wager to be placed on one or more of such paylines to activate such paylines. In other embodiments in which one or more paylines are formed between at least two adjacent symbol display areas, the EGM enables a wager to be placed on a plurality of symbol display areas, which activates those symbol display areas.

In various embodiments, the EGM provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the EGM employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; U.S. Pat. No. 8,241,104, entitled "Gaming Device and Method Having Designated Rules for Determining Ways To Win"; and U.S. Pat. No. 8,430,739, entitled "Gaming System and Method Having Wager Dependent Different Symbol Evaluations."

In various embodiments, the EGM includes a progressive award. Typically, a progressive award includes an initial amount and an additional amount funded through a portion of each wager placed to initiate a play of a primary game. When one or more triggering events occurs, the EGM provides at least a portion of the progressive award. After the EGM provides the progressive award, an amount of the progressive award is reset to the initial amount and a portion of each subsequent wager is allocated to the next progressive award. Examples of progressive gaming systems or EGMs are described in U.S. Pat. No. 7,585,223, entitled "Server Based Gaming System Having Multiple Progressive Awards"; U.S. Pat. No. 7,651,392, entitled "Gaming Device System Having Partial Progressive Payout"; U.S. Pat. No. 7,666,093, entitled "Gaming Method and Device Involving Progressive Wagers"; U.S. Pat. No. 7,780,523, entitled "Server Based Gaming System Having Multiple Progressive Awards"; and U.S. Pat. No. 8,337,298, entitled "Gaming Device Having Multiple Different Types of Progressive Awards."

As generally noted above, in addition to providing winning credits or other awards for one or more plays of the primary game(s), in various embodiments the EGM provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). The secondary game(s) may be any type of suitable game, either similar to or completely different from the primary game.

In various embodiments, the EGM automatically provides or initiates the secondary game upon the occurrence of a triggering event or the satisfaction of a qualifying condition. In other embodiments, the EGM initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. Any suitable triggering event or qualifying condition or any suitable combination of a plurality of different triggering events or qualifying conditions may be employed.

In other embodiments, at least one processor of the EGM randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the EGM determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win."

In various embodiments, the gaming system or EGM includes one or more player tracking systems. Such player tracking systems enable operators of the gaming system or EGM (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the EGM to begin a gaming session, the card reader reads the player identification number off the player tracking card to identify the player. The EGM timely tracks any suitable information or data relating to the identified player's gaming session. The EGM also timely tracks when the player tracking card is removed to conclude play for that gaming session. In another embodiment, rather than requiring insertion of a player tracking card into the card reader, the EGM utilizes one or more portable devices, such as a mobile phone, a radio frequency identification tag, or any other suitable wireless device, to track when a gaming session begins and ends. In another embodiment, the EGM utilizes any suitable biometric technology or ticket technology to track when a gaming session begins and ends.

In such embodiments, during one or more gaming sessions, the EGM tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the first display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No. 7,617,151, entitled "Alternative Player Tracking Techniques"; and U.S. Pat. No. 8,057,298, entitled "Virtual Player Tracking and Related Services."

Certain of the gaming systems described herein, including EGMs located in a casino or another gaming establishment, include certain components and/or are configured to operate in certain manners that differentiate these EGMs and systems from general purpose computing devices (i.e., certain personal gaming devices such as desktop computers and laptop computers).

For instance, EGMs are highly regulated to ensure fairness and, in many cases, EGMs are configured to award monetary awards up to multiple millions of dollars. To satisfy security and regulatory requirements in a gaming environment, hardware and/or software architectures are implemented in EGMs that differ significantly from those of general purpose computing devices. For purposes of illustration, a description of EGMs relative to general purpose computing devices and some examples of these additional (or different) hardware and/or software architectures found in EGMs are described below.

At first glance, one might think that adapting general purpose computing device technologies to the gaming industry and EGMs would be a simple proposition because both general purpose computing devices and EGMs employ processors that control a variety of devices. However, due to at least: (1) the regulatory requirements placed on EGMs, (2) the harsh environment in which EGMs operate, (3) security requirements, and (4) fault tolerance requirements, adapting general purpose computing device technologies to EGMs can be quite difficult. Further, techniques and methods for solving a problem in the general purpose computing device industry, such as device compatibility and connectivity issues, might not be adequate in the gaming industry. For instance, a fault or a weakness tolerated in a general purpose computing device, such as security holes in software or frequent crashes, is not tolerated in an EGM because in an EGM these faults can lead to a direct loss of funds from the EGM, such as stolen cash or loss of revenue when the EGM is not operating properly or when the random outcome determination is manipulated.

Certain differences between general purpose computing devices and EGMs are described below. A first difference between EGMs and general purpose computing devices is that EGMs are state-based systems. A state-based system stores and maintains its current state in a non-volatile memory such that, in the event of a power failure or other malfunction, the state-based system can return to that state when the power is restored or the malfunction is remedied. For instance, for a state-based EGM, if the EGM displays an award for a game of chance but the power to the EGM fails before the EGM provides the award to the player, the EGM stores the pre-power failure state in a non-volatile memory, returns to that state upon restoration of power, and provides the award to the player. This requirement affects the software and hardware design on EGMs. General purpose computing devices are typically not state-based machines, and a majority of data can be lost when a malfunction occurs on a general purpose computing device.

A second difference between EGMs and general purpose computing devices is that, for regulatory purposes, the software on the EGM utilized to operate the EGM has been designed to be static and monolithic to prevent cheating by the operator of the EGM. For instance, one solution that has been employed in the gaming industry to prevent cheating and to satisfy regulatory requirements has been to manufacture an EGM that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the EGM in the presence of a gaming regulator. Regardless of whether the EPROM solution is used, to gain approval in most gaming jurisdictions, an EGM must demonstrate sufficient safeguards that prevent an operator or a player of an EGM from manipulating the EGM's hardware and software in a manner that gives him an unfair, and in some cases illegal, advantage.

A third difference between EGMs and general purpose computing devices is authentication—EGMs storing code are configured to authenticate the code to determine if the code is unaltered before executing the code. If the code has been altered, the EGM prevents the code from being executed. The code authentication requirements in the gaming industry affect both hardware and software designs on EGMs. Certain EGMs use hash functions to authenticate code. For instance, one EGM stores game program code, a hash function, and an authentication hash (which may be encrypted). Before executing the game program code, the EGM hashes the game program code using the hash function to obtain a result hash and compares the result hash to the authentication hash. If the result hash matches the authentication hash, the EGM determines that the game program code is valid and executes the game program code. If the result hash does not match the authentication hash, the EGM determines that the game program code has been altered (i.e., may have been tampered with) and prevents execution of the game program code. Examples of EGM code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes."

A fourth difference between EGMs and general purpose computing devices is that EGMs have unique peripheral device requirements that differ from those of a general purpose computing device, such as peripheral device security requirements not usually addressed by general purpose computing devices. For instance, monetary devices, such as coin dispensers, bill validators, and ticket printers and computing devices that are used to govern the input and output of cash or other items having monetary value (such as tickets) to and from an EGM have security requirements that are not typically addressed in general purpose computing devices. Therefore, many general purpose computing device techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain EGMs use a watchdog timer to provide a software failure detection mechanism. In a normally-operating EGM, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain EGMs use several power supply voltages to operate portions of the computer circuitry. These can be generated in a central power supply or locally on the computer board. If any of these voltages falls out of the tolerance limits of the circuitry they power, unpredictable operation of the EGM may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain EGMs have power supplies with relatively tighter voltage margins than that required by the operating circuitry. In addition, the voltage monitoring circuitry implemented in certain EGMs typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the EGM.

As described above, certain EGMs are state-based machines. Different functions of the game provided by the EGM (e.g., bet, play, result, points in the graphical presentation, etc.) may be defined as a state. When the EGM moves a game from one state to another, the EGM stores critical data regarding the game software in a custom non-volatile memory subsystem. This ensures that the player's wager and credits are preserved and to minimize potential disputes in the event of a malfunction on the EGM. In general, the EGM does not advance from a first state to a second state until critical information that enables the first state to be reconstructed has been stored. This feature enables the EGM to recover operation to the current state of play in the event of a malfunction, loss of power, etc. that occurred just prior to the malfunction. In at least one embodiment, the EGM is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the EGM memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve EGM critical data, although other types of non-volatile memory devices may be employed. These memory devices are typically not used in typical general purpose computing devices.

Thus, in at least one embodiment, the EGM is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of EGM critical information) within a time period of 200 milliseconds or less. In at least one embodiment, the time period of 200 milliseconds represents a maximum amount of time for which sufficient power may be available to the various EGM components after a power outage event has occurred at the EGM.

As described previously, the EGM may not advance from a first state to a second state until critical information that enables the first state to be reconstructed has been atomically stored. After the state of the EGM is restored during the play of a game of chance, game play may resume and the game may be completed in a manner that is no different than if the malfunction had not occurred. Thus, for example, when a malfunction occurs during a game of chance, the EGM may be restored to a state in the game of chance just prior to when the malfunction occurred. The restored state may include metering information and graphical information that was displayed on the EGM in the state prior to the malfunction. For example, when the malfunction occurs during the play of a card game after the cards have been dealt, the EGM may be restored with the cards that were previously displayed as part of the card game. As another example, a bonus game may be triggered during the play of a game of chance in which a player is required to make a number of selections on a video display screen. When a malfunction has occurred after the player has made one or more selections, the EGM may be restored to a state that shows the graphical presentation just prior to the malfunction including an indication of selections that have already been made by the player. In general, the EGM may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the EGM and the state of the EGM (e.g., credits) at the time the game of chance was played. The game history information may be utilized in the event of a dispute. For example, a player may decide that in a previous game of chance that they did not receive credit for an award that they believed they won. The game history information may be used to reconstruct the state of the EGM prior to, during, and/or after the disputed game to demonstrate whether the player was correct or not in her assertion. Examples of a state-based EGM, recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play."

Another feature of EGMs is that they often include unique interfaces, including serial interfaces, to connect to specific subsystems internal and external to the EGM. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the EGM, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between EGMs. As another example, SAS is a communication protocol used to transmit information, such as metering information, from an EGM to a remote device. Often SAS is used in conjunction with a player tracking system.

Certain EGMs may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an EGM by monitoring security switches attached to access doors in the EGM cabinet. Access violations result in suspension of game play and can trigger additional security operations to preserve the current state of game play. These circuits also function when power is off by use of a battery backup. In power-off operation, these circuits continue to monitor the access doors of the EGM. When power is restored, the EGM can determine whether any security violations occurred while power was off, e.g., via software for reading status registers. This can trigger event log entries and further data authentication operations by the EGM software.

Trusted memory devices and/or trusted memory sources are included in an EGM to ensure the authenticity of the software that may be stored on less secure memory subsystems, such as mass storage devices. Trusted memory devices and controlling circuitry are typically designed to not enable modification of the code and data stored in the memory device while the memory device is installed in the EGM. The code and data stored in these devices may include authentication algorithms, random number generators, authentication keys, operating system kernels, etc. The purpose of these trusted memory devices is to provide gaming regulatory authorities a root trusted authority within the computing environment of the EGM that can be tracked and verified as original. This may be accomplished via removal of the trusted memory device from the EGM computer and verification of the secure memory device contents is a separate third party verification device. Once the trusted memory device is verified as authentic, and based on the approval of the verification algorithms included in the trusted device, the EGM is enabled to verify the authenticity of additional code and data that may be located in the gaming computer assembly, such as code and data stored on hard disk drives. Examples of trusted memory devices are described in U.S. Pat. No. 6,685,567, entitled "Process Verification."

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

EGMs storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment."

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, EGMs that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System."

It should further be appreciated that the EGM of the present disclosure may have varying or alternative housing configurations.

It should further be appreciated that the EGM of the present disclosure may have varying or alternative display device configurations.

In various embodiments, the EGM of the present disclosure is configured to be positioned on a base or stand.

Various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. An electronic gaming machine comprising:

a housing;

a display device supported by the housing;

a head position tracker supported by the housing;

a processor; and a memory device that stores a plurality of instructions that, when executed by the processor, cause the processor to:

cause the display device to display a play of a game;

operate with the head position tracker to capture player head position information;

determine a head position of a player of the electronic gaming machine based on the player head position information;

cause the display device to display an image comprising a 2D or 3D object, the 2D or 3D object having an object location with respect to a screen of the display device;

cause the display device to generate a sound associated with the 2D or 3D object, wherein the sound emanates from a sound location on the screen of the display device determined based on the object location, wherein the sound location on the screen of the display device, the object location, and the head position are aligned along a first axis;

operate with the head position tracker to detect movement of the head position of the player with respect to the display device; and responsively move the sound location on the screen of the display device such that the sound location, the object location, and the head position are in alignment along a second axis, wherein the second axis is different than the first axis.

2. The electronic gaming machine of claim 1, wherein the plurality of instructions, when executed by the processor, cause the processor to:

detect movement of the object location with respect to the display device; and responsively move the sound location on the screen of the display device such that the sound location, the object location, and the head position are in alignment along a third axis, wherein the third axis is different than the first axis.

3. The electronic gaming machine of claim 1, wherein the plurality of instructions, when executed by the processor, cause the processor to:

cause the display device to modify a volume of the sound based on the sound location on the screen of the display device.

4. The electronic gaming machine of claim 3, wherein the plurality of instructions, when executed by the processor, cause the processor to:

determine a distance between the head position of the player and the sound location on the screen of the display device; and cause the display device to modify the volume of the sound based on the distance.

5. An electronic gaming machine comprising:

a housing;

a display device supported by the housing;

a processor; and a memory device that stores a plurality of instructions that, when executed by the processor, cause the processor to:

cause the display device to display a play of a game, wherein the play of the game includes a plurality of symbols each having a symbol location relative to a screen of the display device;

cause the display device to generate a plurality of sounds corresponding to the plurality of symbols, wherein the plurality of sounds each emanate from a corresponding symbol location on the screen of the display device, and wherein the plurality of sounds includes a first set of sounds and a different second set of sounds;

determine a first game state corresponding to the play of the game;

cause the display device to generate the first set of sounds corresponding to the plurality of symbols, wherein the first set of sounds are based on the first game state;

determine a second game state corresponding to the play of the game; and cause the display device to generate the second set of sounds corresponding to the plurality of symbols, wherein the second set of sounds are based on the second game state, and wherein the first set of sounds is different than the second set of sounds.

6. The electronic gaming machine of claim 5, wherein the plurality of symbols include a plurality of different symbols, and wherein each different symbol corresponds to a different sound of the plurality of sounds.

7. The electronic gaming machine of claim 5, wherein the plurality of instructions, when executed by the processor, cause the processor to:

cause a first symbol of the plurality of symbols to move from a first symbol location to a second symbol location; and cause a sound corresponding to the first symbol to be emanated from the display device along a path connecting the first symbol location and the second symbol location.

8. The electronic gaming machine of claim 5, wherein the game comprises a plurality of spinning reels, wherein the first game state comprises:

a first reel of the plurality of reels stopped and showing a first symbol; and a second reel of the plurality of reels stopped and showing the first symbol; and wherein the second game state comprises:

all of the plurality of reels stopped such that a winning combination of symbols is shown, wherein the winning combination of symbols includes the first symbol.

9. An electronic gaming machine comprising:

a housing;

a display device supported by the housing;

a head position tracker supported by the housing;

a processor; and a memory device that stores a plurality of instructions that, when executed by the processor, cause the processor to:

cause the display device to display a play of a game;

operate with the head position tracker to capture player head position information;

determine a head position of a player of the electronic gaming machine based on the player head position information;

cause the display device to display an image comprising a 2D or 3D object, the 2D or 3D object having an object location with respect to a screen of the display device;

cause the display device to generate a sound associated with the 2D or 3D object, wherein the sound emanates from a sound location on the screen of the display device determined based on the object location, wherein the sound location on the screen of the display device, the object location, and the head position are aligned along a first axis;

detect movement of the object location with respect to the display device; and responsively move the sound location on the screen of the display device such that the sound location, the object location, and the head position are in alignment along a second axis, wherein the second axis is different than the first axis.

* * * * *